US008746728B2

(12) United States Patent
Shute et al.

(10) Patent No.: US 8,746,728 B2
(45) Date of Patent: Jun. 10, 2014

(54) HEEL UNIT FOR ALPINE TOURING BINDING

(75) Inventors: Cameron Allan Shute, Nelson (CA); Ernest Dawson McCrank, North Vancouver (CA); Robert Erik Moore, North Vancouver (CA); Paul Matthew Palfreyman, Vancouver (CA); James William Rogers, Toronto (CA)

(73) Assignee: G3 Genuine Guide Gear Inc., North Vancouver (CA)

( * ) Notice: Subject to any disclaimer, the term of this patent is extended or adjusted under 35 U.S.C. 154(b) by 756 days.

(21) Appl. No.: 12/919,241

(22) PCT Filed: Feb. 20, 2009

(86) PCT No.: PCT/CA2009/000206

§ 371 (c)(1),
(2), (4) Date: Mar. 7, 2011

(87) PCT Pub. No.: WO2009/105866

PCT Pub. Date: Sep. 3, 2009

(65) Prior Publication Data

US 2011/0203138 A1 Aug. 25, 2011

Related U.S. Application Data

(60) Provisional application No. 61/064,367, filed on Feb. 29, 2008, provisional application No. 61/193,358, filed on Nov. 20, 2008.

(51) Int. Cl.

| | |
|---|---|
| ***A63C 5/00*** | (2006.01) |
| ***A63C 9/084*** | (2012.01) |
| ***A63C 7/10*** | (2006.01) |
| ***A63C 9/086*** | (2012.01) |
| ***A63C 9/00*** | (2012.01) |

(52) U.S. Cl.

CPC ..... *A63C 7/1013* (2013.01); *A63C 9/0846* (2013.01); *A63C 9/0845* (2013.01); *A63C 9/086* (2013.01); *A63B 9/0807* (2013.01); *A63C 9/006* (2013.01)

USPC ..... 280/614; 280/607; 280/615

(58) Field of Classification Search

CPC ..... A63C 5/00

USPC ..... 280/614, 616, 617, 618, 624, 605, 607, 280/615

See application file for complete search history.

(56) References Cited

U.S. PATENT DOCUMENTS

| | | | | |
|---|---|---|---|---|
| 4,261,595 | A | 4/1981 | Smialowski et al. | |
| 4,273,355 | A * | 6/1981 | Storandt | 280/614 |

(Continued)

FOREIGN PATENT DOCUMENTS

| | | |
|---|---|---|
| AT | 402020 | 1/1997 |
| CA | 2360819 | 7/2000 |

(Continued)

OTHER PUBLICATIONS

Geze Alpine Binding Adapter for Backcountry Skiing Randonnee—Virtual Museum. (http://www.wildsnow.com/backcountry-ski-museum/geze-1960s-adapter/geze-touring-at -adapter-1960s.html). 2 pages. Jun. 24, 2009.

(Continued)

*Primary Examiner* — Hau Phan

(57) ABSTRACT

An alpine touring heel unit is provided which comprises a base for mounting the heel unit and an upper portion with a heel connector. The upper portion is slidably engageable with the base for movement by a user into a downhill position and a touring position spaced rearwardly from the downhill position for disconnection of the heel connector. Complete movement in at least one direction between the downhill and touring positions may be actuated by a single motion by the user. Also provided is a heel unit movable between downhill and touring positions which comprises a heel support pivotally coupled to the heel unit. Also provided is a heel unit comprising a post and a body with a heel connector, the body being coaxially mounted on the post and rotatable between opposing lateral release positions and further containing a biasing device mounted outside of the body. Also provided are kits comprising a heel unit of this invention and a toe unit which functions independently from the heel unit.

39 Claims, 30 Drawing Sheets

(56) References Cited

U.S. PATENT DOCUMENTS

| | | | | | |
|---|---|---|---|---|---|
| 4,500,108 | A * | 2/1985 | Johnson, III | ..... | 280/614 |
| 4,674,766 | A * | 6/1987 | Ramer | ..... | 280/614 |
| 4,887,833 | A * | 12/1989 | Bailey | ..... | 280/615 |
| 5,002,303 | A * | 3/1991 | Freisinger et al. | ..... | 280/605 |
| 5,318,320 | A * | 6/1994 | Ramer | ..... | 280/614 |
| 5,364,118 | A * | 11/1994 | Burger et al. | ..... | 280/614 |
| 5,741,023 | A | 4/1998 | Schiele et al. | | |
| 6,431,578 | B2 * | 8/2002 | Pedersen et al. | ..... | 280/626 |
| 7,267,356 | B2 * | 9/2007 | Buquet et al. | ..... | 280/616 |
| 8,181,985 | B2 * | 5/2012 | Mangold et al. | ..... | 280/614 |
| 2008/0309053 | A1 * | 12/2008 | Mangold et al. | ..... | 280/614 |

FOREIGN PATENT DOCUMENTS

| | | |
|---|---|---|
| DE | 2806937 | 8/1978 |
| EP | 0199098 | 10/1986 |
| EP | 0519243 | 12/1992 |
| EP | 1559455 | 8/2005 |
| EP | 1559457 | 8/2005 |
| EP | 1679099 | 7/2006 |
| IT | 0001360160 | 1/2005 |
| WO | 2007/060219 | 5/2007 |

OTHER PUBLICATIONS

Alpine Touring Bindings- Dynafit Rental Plate. Apr. 13, 2004. (http://telemark-pyrenees.com/Bindings-AT.htm). 5 pages. Jun. 15, 2012.

Click-Clack Dynafit Aftermarket Heel Unit-Review—The Backcountry Skiing Blog. May 29, 2006. (http://www.wildsnow.com/277/click-clack-dynafit-aftermarker-heel-unit-review). 5 pages. Posted by Lou Dawson. May 28, 2013.

International Search Report. PCT/CA2009/000206. Completed Jun. 9, 2009. 6 pages.

Written Opinion of the International Search Authority. PCT/CA2009/000206. Mailed Jun. 17, 2009. 6 pages.

* cited by examiner

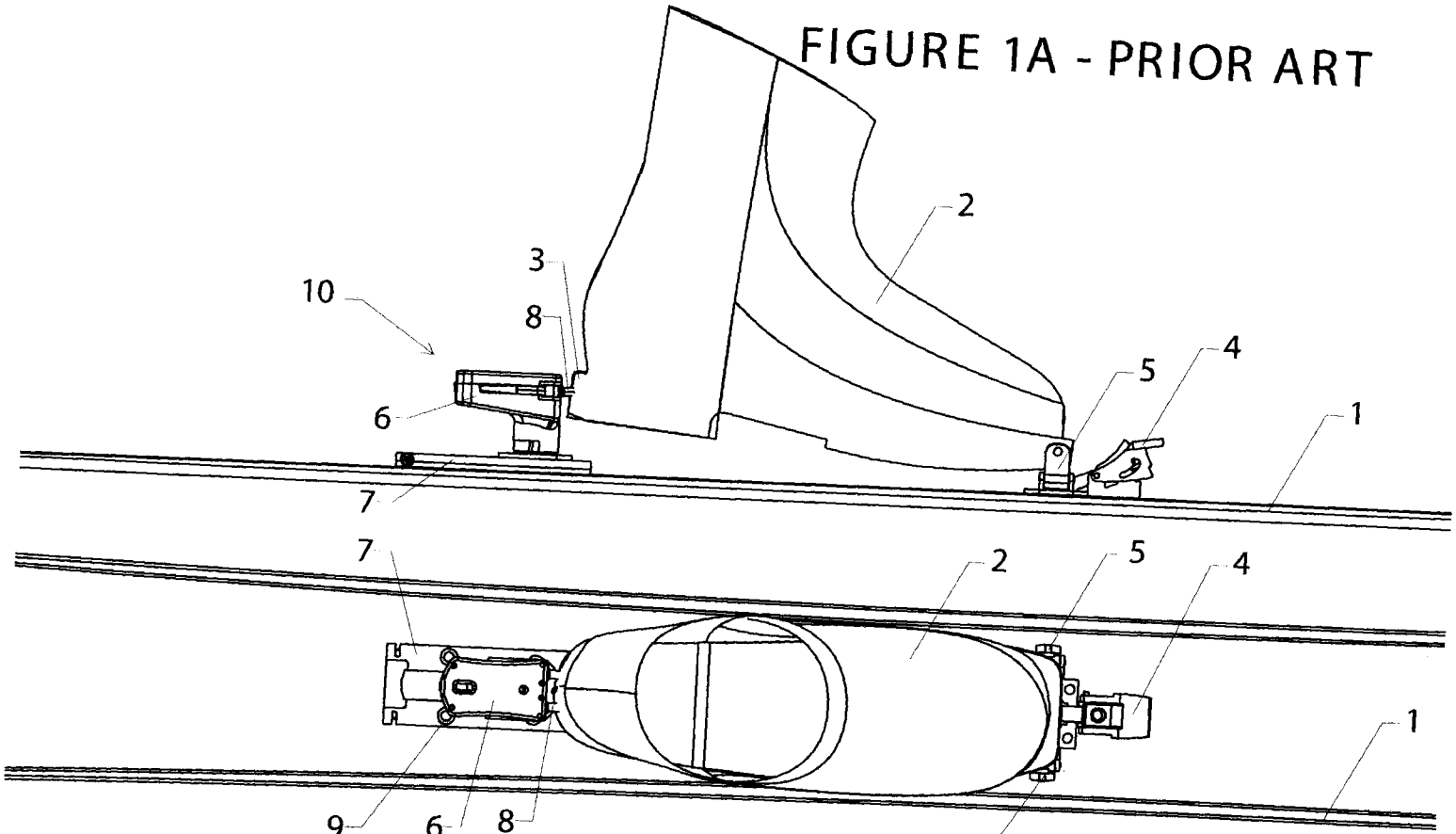
FIGURE 1A - PRIOR ART
FIGURE 1B - PRIOR ART

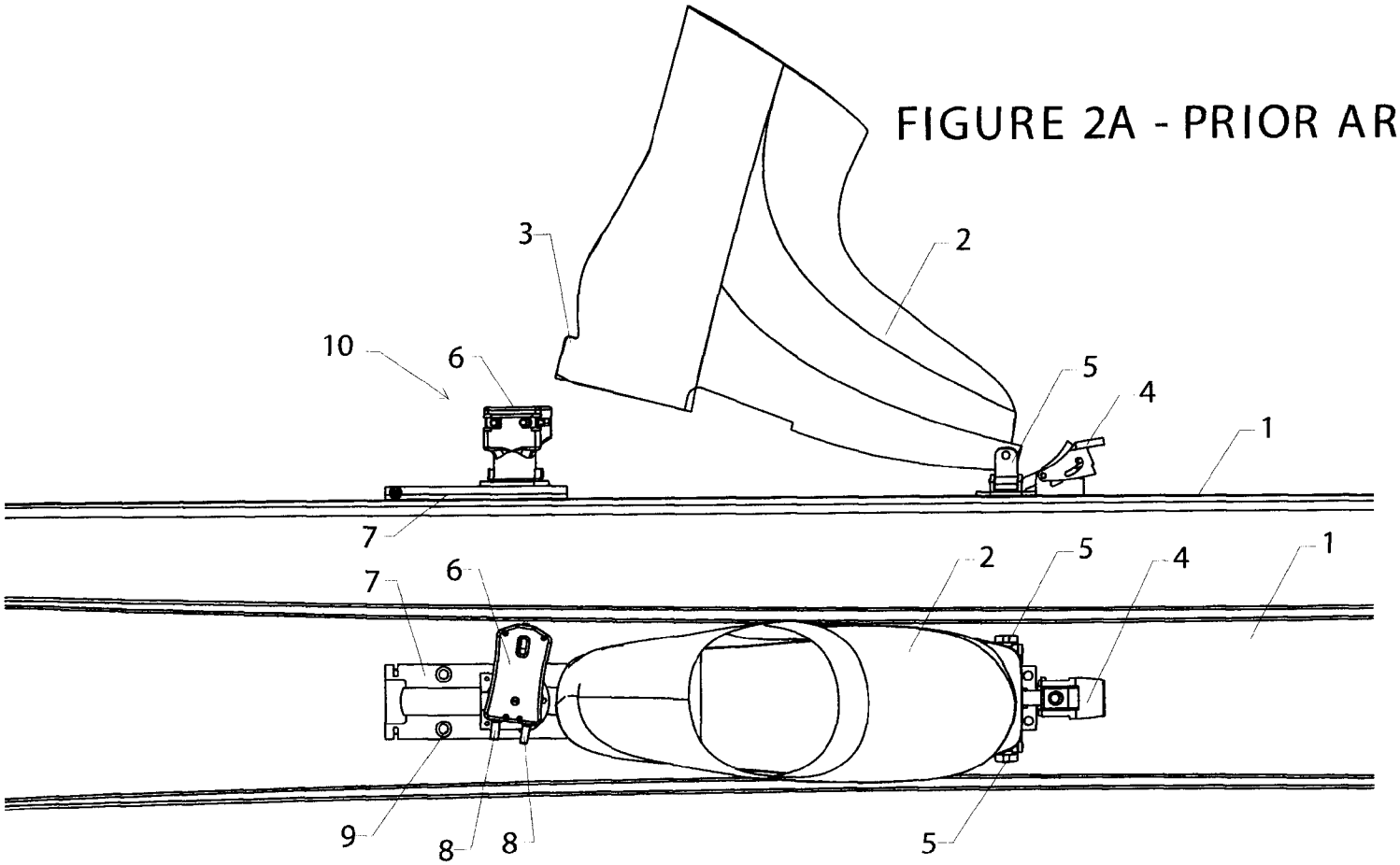
FIGURE 2A - PRIOR ART
FIGURE 2B - PRIOR ART

FIGURE 3 - PRIOR ART
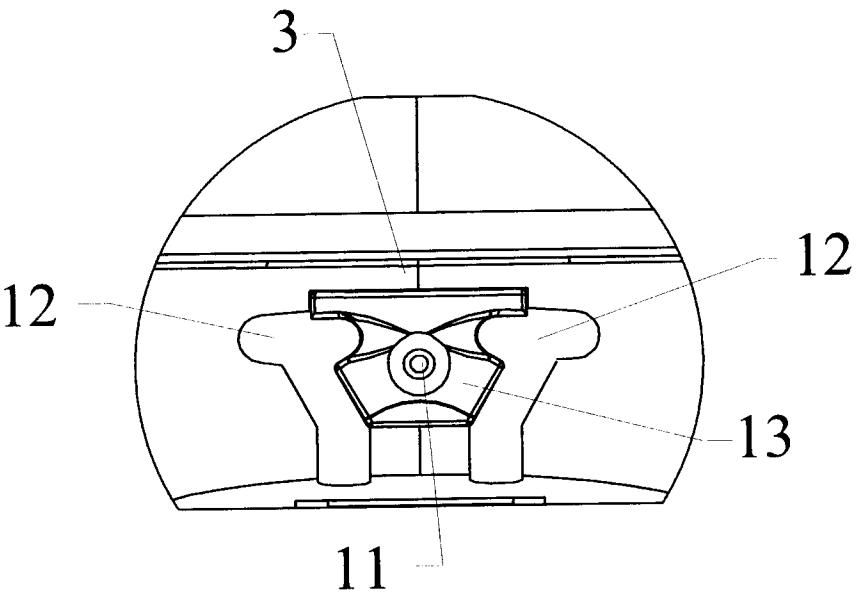

HEEL UNIT FOR ALPINE TOURING BINDING

RELATED APPLICATIONS

This applications claims priority from U.S. patent applications 61/064,367 filed Feb. 29, 2008, and 61/193,358 filed Nov. 20, 2008.

FIELD OF THE INVENTION

This invention relates to release bindings used in alpine ski touring, also known as "Randonnee".

BACKGROUND OF THE INVENTION

Alpine touring bindings allow the heel of the user's footwear (such as a ski boot) to be latched to a snow travel aid (such as a ski), for sliding downhill (the "downhill mode") and allow the heel to be released for walking and climbing (the "touring mode"). Release bindings allow the footwear to release from the snow travel aid when in the downhill mode, in case of a fall. When in the touring mode, the user may climb or walk with a great degree of freedom since the footwear is pivotally engaged with the aid near the toe of the footwear while the heel of the footwear is free to move upward and downward relative to the aid. A historical collection of such bindings can be viewed in the "Virtual Museum of Backcountry Skiing Bindings" at www.wildsnow.com, authored by Louis Dawson.

Alpine touring bindings sold under the brand DYNAFIT are release bindings that take advantage of the fact that modern alpine touring boots have a rigid sole. Thus, it is unnecessary to provide a bar, plate or other arrangement connecting the toe and heel units, as is the case with many other alpine touring bindings (see patent publications EP0199098, EP0519243, EP1559457, and AT402020).

The DYNAFIT™ binding system comprises a toe unit which has a set of jaws that pivotally engage a special insert in the footwear sole. The toe unit is mountable at an appropriate location on the upper surface of a snow travel aid. A separate heel unit is mountable at a particular region on the upper surface rearward of the toe unit, the location of which is dictated by the length of the footwear sole. The toe and heel units function independently in retaining the footwear attached to the snow travel aid. The heel unit comprises projections (typically a pair of pins) which extend forward to engage opposite sides of a fitting placed over a cavity in the rear of the footwear heel. Under forward release conditions, the pins are intended to be forced apart against spring pressure to respective release positions to disengage from the fitting and the heel. The pins communicate with a spring or springs through inclined sliding surfaces that move a block which engages the spring or springs at a central region of the block. This arrangement can result in forward release occurring when only one pin is displaced.

Fore and aft adjustment of the DYNAFIT™ heel unit to position the pins at an optimum depth in the heel fitting and to accommodate a limited range of different footwear sizes is provided by means of a threaded rod that moves a main portion of the heel unit relative to a base plate which is fixed to the upper surface of the snow travel aid. This is a fine adjustment that must be carried out by means of numerous rotations of the threaded rod, through the application of a tool such as a screwdriver or hex key.

The heel unit of a DYNAFIT™ binding provides lateral release primarily as a result of the body of the heel unit which contains the pins being pivotally engaged on a vertical post. Variable release settings are provided by adjusting compression of a spring that is internal to the body which forces a plunger against flattened portions arranged on the post circumference. There is a limited capacity for release values since the lateral and forward release components are all housed within the rotating body. In particular, the lateral release plunger is subjected to large and varying forces since it functions as part of a release mechanism and is also the means whereby the rotating component is retained on the base component.

To switch between touring and downhill modes with the DYNAFIT™ system, it is necessary to rotate the heel unit so that the pins either engage the footwear heel (downhill mode) or face away from the heel (touring mode). When the pins are facing away, the footwear heel is free to move upward and downward. A series of steps on the heel unit may also be provided which, upon rotation of the heel unit to different positions in the touring mode, allow the heel to be supported at varying heights above the snow travel aid to provide comfort during climbing. In order to switch from downhill mode to touring mode it is necessary to either forcibly release the pins from the fitting on the heel (not recommended) or disengage the toe unit from the footwear, so that the footwear completely exits from the binding system whereupon the heel unit may be rotated to a position in the touring mode. This can be difficult to do in deep snow or on steep slopes. Also, the DYNAFIT™ heel unit can rotate on its own while in the tour mode, occasionally causing the heel unit to inadvertently switch to the downhill mode.

The snow brake for the DYNAFIT™ binding is positioned to not contact snow while in the touring mode by the user forcing the heel plate of the brake downwards while simultaneously rotating the heel unit to a position in the touring mode. This requires a two-handed or other dual motion activity on the part of the user, which can be difficult to accomplish while in deep snow or when poised in a precarious location. Also, the brake unit may occasionally not deploy in a fall because the position of the heel unit in touring mode whereby the brake is restrained from deployment is very close to the position that the heel unit assumes during a lateral release.

SUMMARY OF THE INVENTION

Various embodiments of this invention provide an apparatus for selectively holding a footwear heel to a snow travel aid, the apparatus comprising: a base mountable to the snow travel aid; and an upper portion having a connector for connecting the apparatus to the heel; wherein the upper portion is slidably engageable with the base for controllable movement by a user of the upper portion relative to the base into: (i) a downhill position whereby the connector would be connected to the heel, and (ii) a touring position spaced rearwardly from the downhill portion whereby the connector would be disconnected from the heel. Typically the footwear is a ski boot and the snow travel aid is a ski.

The aforementioned embodiments may be ones in which complete movement in at least one direction between the downhill and touring positions is actuated by a single motion of an actuator by the user. In some embodiments, a single motion of the actuator will drive the complete movement in at least one such direction. In other embodiments, a single motion of the actuator by the user actuates a mechanism that then drives the complete movement independent of user activity. Furthermore, single motions of the actuator in opposite directions may result in complete movement in opposite directions between the downhill and touring positions. The actuator may be a lever.

The aforementioned embodiments may also comprise one or more catches and/or springs for holding the upper portion in the downhill position, the touring position or both or for urging the apparatus to such positions. In some embodiments, movement of a heel support towards a deployed position may actuate movement of the upper portion to the touring position.

Some of the aforementioned embodiments may comprise a brake moveable between a braking position whereby the brake is positioned to contact snow, and a raised position whereby the brake would be raised from the snow, wherein the base includes a brake holder moveable in response to movement of the upper portion, the brake holder for holding the brake in the raised position when the upper portion is in the touring position.

In some of the aforementioned embodiments, the upper portion includes a post and a body coaxially and rotatably mountable on the post, with an outer periphery of the body comprises at least one camming surface which contacts a biasing device mounted independent of the body. The biasing device urges the body to remain between said releasing positions.

In some of the aforementioned embodiments, the connector comprises one or more projections for insertion into one or more cavities in the footwear heel. In some such embodiments, the projections are first and second laterally spaced pins, the pins being moveable relative to the upper portion between respective heel holding positions and respective heel releasing positions; the upper portion further comprising first and second levers rotatably coupled thereto for urging the first and second pins respectively into the respective heel holding positions; and a biasing device in communication with the first and second levers for applying a force to the first and second levers to urge the first and second pins respectively into the respective heel holding positions. The levers may be independently moveable and the biasing device may comprise one or more springs and a plunger. The plunger may contact each of the levers at spaced apart points on the plunger, increasing the likelihood that movement of the plunger against the force of the spring will only occur when both pins are displaced towards their respective heel releasing positions. This allows for more consistent forward release characteristics.

Various embodiments of this invention provide an apparatus for selectively holding a footwear heel to a snow travel aid, the apparatus comprising first and second pins spaced laterally apart for insertion into at least one cavity in said heel to connect the apparatus to the heel, the pins being laterally moveable between respective heel holding positions and respective heel releasing positions; the apparatus further comprising first and second levers rotatably coupled thereto which contact the first and second pins and a biasing device in communication with the first and second levers for applying a force to the first and second levers to urge the first and second pins into their respective heel holding positions. The biasing device may be a combination of a plunger and one or more springs including features described above.

Various embodiments of this invention provide an apparatus for selectively holding a footwear heel to a snow travel aid, the apparatus comprising a connector for connecting the apparatus to the heel, a post projecting along a generally vertical axis and a body coaxially and rotatably mountable on the post, and wherein an outer periphery of the body comprises at least one camming surface and contacts a biasing device, the biasing device being mounted independent of the body and urges the body to a central position between said release positions. The biasing device may be connected to the post and may be enclosed in a housing separate from the body.

Various embodiments of this invention provide a binding kit comprising toe and heel units, each unit for selectively holding footwear to a snow travel aid, the toe unit being configured to function independently from the heel unit to retain the footwear on the snow travel aid while permitting forward and rearward movement of the footwear, and wherein the heel unit is an apparatus of this invention as described above. In some embodiments, the toe and heel units are separate and not connected, except when mounted on a snow travel aid. The kit may further comprise fasteners for attachment of the toe and heel units to the snow travel aid. The kit may also comprise instructions for one or more of installation, maintenance, adjustment, and use of the toe and heel units.

Some embodiments of this invention include a heel unit for an alpine touring binding where the heel unit comprises forwardly directed projections which releasably engage the footwear heel, including such forms of heel engagement used in DYNAFIT™ binding systems and the aforementioned patent publications. Some embodiments of this invention provide an advantage over the DYNAFIT™ systems in that a heel unit of this invention is moveable in fore and aft directions generally along the longitudinal axis of the snow travel aid to permit engagement and disengagement with the footwear heel without having to remove the footwear from the binding system or rotate the heel unit, as in the prior art device. A heel unit of this invention may comprise an upper portion that is slidable in fore and aft directions relative to a base component that is mountable on a snow travel aid.

Movement of a heel unit of this invention in a forward direction, backward direction (or both) is generally along the longitudinal axis of the snow travel aid and may be actuated (either simply initiated or completely driven) by the user moving a lever that results in the heel unit translating a substantial distance along the longitudinal axis of the snow travel aid. This movement permits the projections that extend from the heel unit to become fully engaged or disengaged from the fitting on the footwear heel. The heel unit may translate along a generally horizontal path or a generally parallel path relative to the surface of the snow travel aid, but deviation from such paths is also contemplated, including translation of the heel unit in a generally arcuate path relative to the upper surface of the snow travel aid. Any suitable lever mechanism may be employed. Examples of mechanical systems that can be actuated by a lever in this invention for translation of the heel unit include: cam, coarsely threaded screws, a rack and pinion, a cable and pulley, a ratchet, and a sliding wedge. Any suitable linkage may be employed including solid and flexible links, with or without pivots. Embodiments of this invention may be adapted such that one or more levers actuate both forward and rearward translation of the heel unit. Catches may also be provided to retain the unit in one or both of the downhill and touring positions and a lever may actuate translation of the heel unit in a direction during which a spring is loaded and the heel unit is moved to a position where it is retained by a catch. Release of the catch in such an embodiment will cause translation of the heel unit in the opposite direction without use of a lever.

In some embodiments, a lever that actuates translation of the heel unit does so in a single motion or "throw". For example, a single motion of the lever may result in translation of the heel unit a sufficient distance to permit the projections of the heel unit to become fully engaged with the footwear heel in the downhill mode, or fully disengaged from the heel in the touring mode. This allows the user with a single motion (e.g., with a ski pole tip) to switch the heel unit in at least one direction between downhill and touring modes. In some embodiments, a lever is restrained by a catch at one or both of the opposite ends of the lever's range of motion so that the lever will tend to remain in one position to avoid accidental translation of the heel unit during downhill sliding or walking/climbing.

In some embodiments of this invention, the upper portion of the heel unit is removable from the base plate permitting transfer of the upper portion to different snow travel aids on which a corresponding base plate has been mounted.

Some of the aforementioned embodiments provide for binding systems which are more easily used, particularly in deep snow or on steep slopes. Switching between downhill and touring modes does not require the footwear to be removed from the binding system and can be accomplished by relatively simple action on the part of the user such as application of a ski pole tip to the lever or a mechanism attached to the lever.

In some embodiments of this invention, actuation of a lever causes both a translation of the heel unit along the longitudinal axis of the snow travel aid, as well as switching of a brake device between downhill and touring modes. The brake retention mechanism may be independent from the binding release components. In embodiments of this invention comprising such a brake, the brake may be placed in a touring position simply by pressing the footwear heel down toward the snow travel aid when the heel unit is in the touring position.

Some embodiments of this invention provide release mechanisms which are capable of being set at high release values (e.g., DIN ratings of 10 or more) and/or at a wide range of release values, because of one or more release components (e.g., a biasing mechanism) being separated from rotary components of the binding. In some embodiments, lateral release components are placed outside of the rotating portion of the heel unit and are attached to a non-rotating component of the unit thereby allowing greater mechanical advantage to be achieved.

In some embodiments of this invention, the forward release mechanism employs independent levers which transmit biasing forces to the pins that engage the footwear heel. While such levers can function independently of one another with regard to each pin, such a mechanism can be adapted to cooperate at spaced apart points on a single plunger that communicates with one or more springs in such a way that lateral force exerted on a single pin will be less likely to cause forward release.

Some embodiments of this invention provide a dedicated system or means for retaining the rotating component onto the heel unit, independent from the binding release mechanisms. This provides for greater durability and rigidity.

Some embodiments of this invention provide an apparatus mountable to a snow travel aid for selectively holding a footwear heel to the snow travel aid, the apparatus comprising a connector for connecting the apparatus to the heel, the connector being moveable between a downhill position whereby the connector would be connected to the heel and a touring position whereby the connector would be disconnected from the heel, the apparatus further comprising a first heel support that is pivotally coupled to the apparatus so that the first heel support will rotate towards the heel to a deployed position and away from the heel to a stowed position. The heel support may be pivotally coupled to opposite sides of the apparatus and straddle the apparatus while rotating. In some embodiments, the heel support will not reach the deployed position when the connector is in the downhill position. Some embodiments further comprise a second heel support that cooperates with the first heel support. The second heel support may be supported by the first heel support when both are in deployed positions.

BRIEF DESCRIPTION OF THE DRAWINGS

FIGS. 1A and 1B are side and plan views, respectively of a ski, ski boot and a prior art binding system.

FIGS. 2A and 2B are side and plan views, respectively showing the combination illustrated in FIGS. 1A and 1B in a touring mode.

FIG. 3 is a partial end view of a boot heel containing a prior art fitting for receiving pins of a prior art heel unit.

DETAILED DESCRIPTION OF PARTICULAR EMBODIMENTS OF THE INVENTION

Figures 4A, 4B:
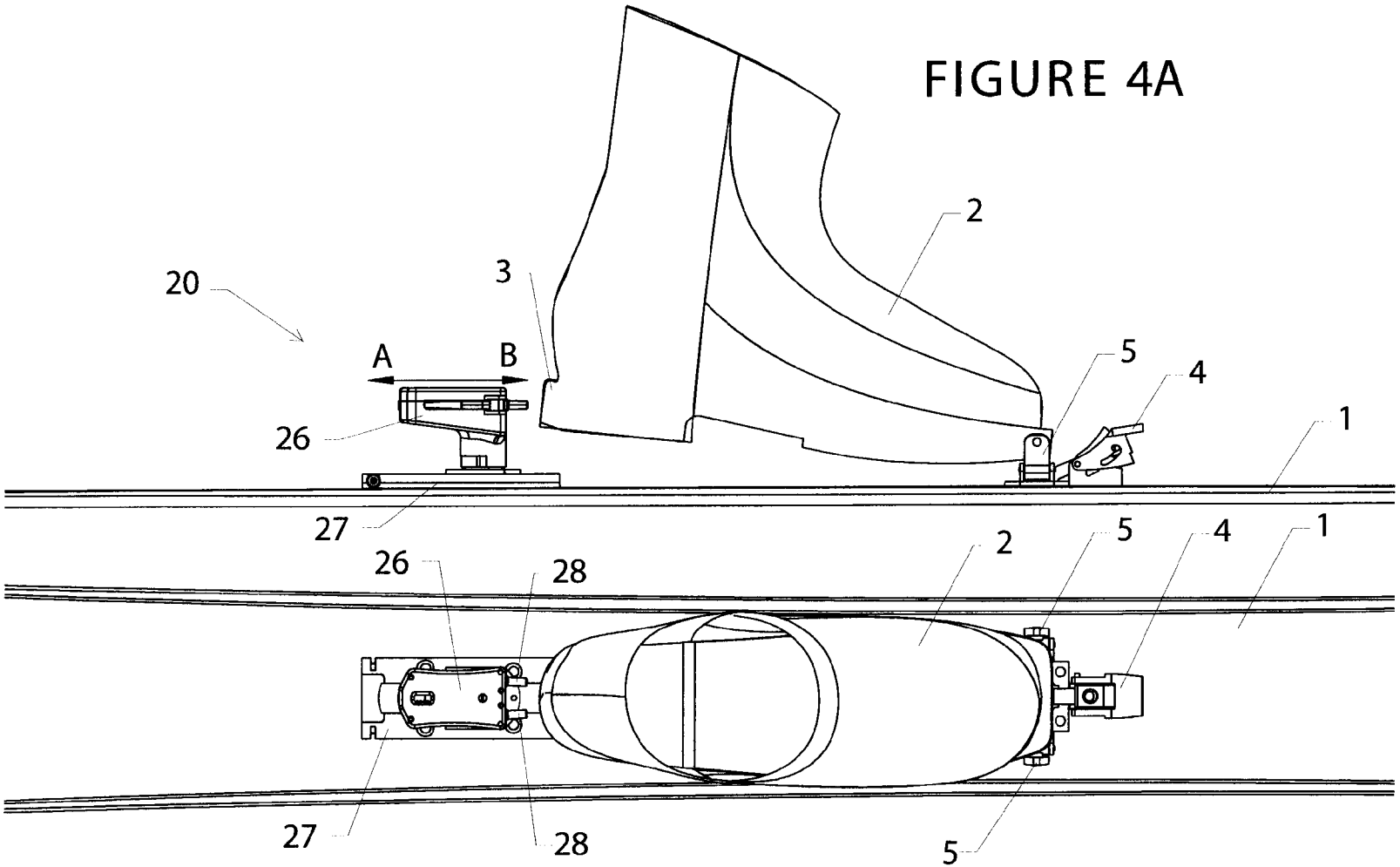
FIGS. 4A and 4B are side and plan views, respectively of a ski, a ski boot, a toe unit, and a heel unit of this invention.

Snow travel aids as contemplated herein are devices that support a user and are adapted to slide on a snow surface. Examples include skis, other snow sliding devices shaped like a ski and snowboards. This includes devices known as "splitboards" (which are snowboards that can be separated longitudinally into at least two portions, the two portions then functioning in a manner similar to a pair of skis). Examples of such other devices include "ski blades", "snow blades", "ski boards", and "sliding" or "gliding snow shoes". An example of the latter device is the configurable snow shoe/ski device described in WO 2000/044846.

In this specification, reference to "Mz" refers to the lateral release characteristic that involves torque applied about an axis that is generally perpendicular to the upper surface of a snow travel aid. The term "My" refers to the forward release characteristic whereby torque is applied about an axis that is generally parallel to the upper surface and generally perpendicular to the longitudinal axis of the snow travel aid.

In this specification, reference to "generally vertical" is intended to indicate a general direction upwards or downwards from a reference but does not require perpendicularity to such reference. Conversely, the term "generally horizontal" includes directions that are perpendicular to those which are "generally vertical" but is not limited to situations involving a line or a plane parallel to the reference. The terms "generally horizontal" and "generally parallel" as used herein include lines or planes that are parallel to a reference as well as those which form an angle of less than 45 degrees with the reference. The term "generally perpendicular" is not limited to a 90 degree orientation but includes orientations that form an angle to a reference of greater than 45 degrees and less than 135 degrees.

FIGS. 1A and 1B show the prior art DYNAFIT™ binding system, including toe unit 4 and heel unit 10 mounted on the upper surface of ski 1. The toe unit comprises jaws 5 that pivotally engage with special fittings (not shown) embedded in the toe of ski boot 2. Dual pins 8 on heel unit 10 engage the rear portion of the boot heel 3. The heel unit comprises a base plate 7 fixed to the ski surface by multiple fasteners 9. Upper portion 6 of the heel unit contains forward directed projections, which are illustrated as a pair of pins 8. The arrangement shown in FIGS. 1A and 1B is the downhill mode with both the toe and heel of the boot engaged by the binding system.

FIGS. 2A and 2B show the prior art DYNAFIT™ system positioned in the touring mode. The toe of the boot remains pivotally engaged to toe unit 4. The heel is free to move up and down relative to the ski because upper portion 6 of the heel unit has been rotated so that pins 8 face away from boot heel 3. In some DYNAFIT™ models, upper portion 6 may be further rotated (not shown) such that pins 8 face rearward of the ski thereby allowing the boot heel 3 to come to rest on an upper surface of upper portion 6. This reduces stress on the user's muscles and tendons while climbing steep hills.

In order to switch from the downhill mode shown in FIGS. 1A and 1B to the touring mode shown in FIGS. 2A and 2B, one must free the pins 8 from the boot heel. The usual method for doing so is to disengage the boot toe from jaws 5, thereby completing exiting the binding system at which point the user is no longer resting on the ski. This is a disadvantage in deep snow. Furthermore, the ski must be prevented from sliding away without the user attached.

FIG. 3 shows part of the rear end of a boot and the prior art boot heel fitting adapted to engage the pins of a DYNAFIT™ heel unit. The upper boot is not shown. Metallic insert 13 is fixed to heel 3 by means of fastener 11. Arcuate cut-away portions on opposite sides of the insert accommodate the pins of the heel unit. These arcuate portions are placed over cavities 12 in the boot heel which receive the ends of the pins.

FIGS. 4A and 4B show operation of a heel unit 20 of this invention together with a prior art toe unit 4. Upper portion 26 of the heel unit is capable of translating in a direction along the longitudinal axis of the ski as shown by arrow A-B. Pins 28 are shown fully disengaged from the boot heel. By moving the heel unit forward, pins 28 may engage boot heel 3. Engagement and disengagement of the pins may be accomplished without removing the boot from the toe unit and without rotating the heel unit.

Figure 5B:
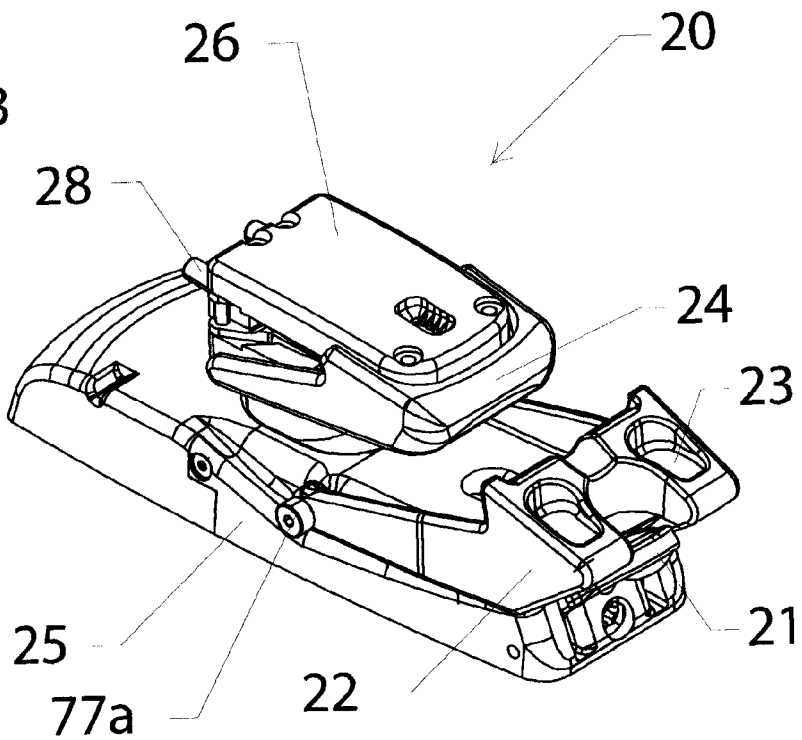
FIGS. 5A and 5B are perspective views of a heel unit of this invention.
Figure 5A:
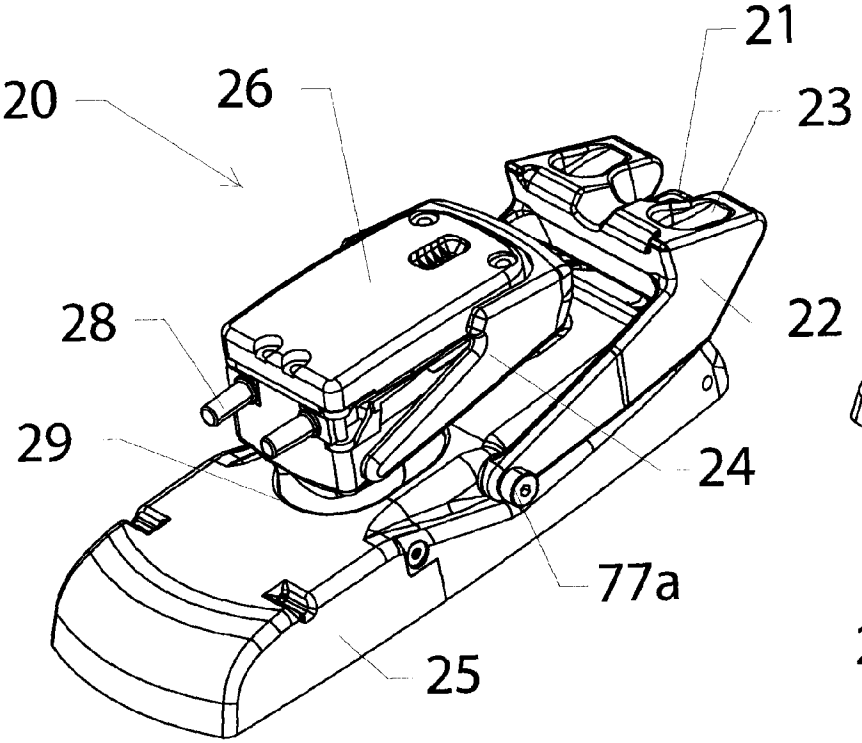
Figure 6B:
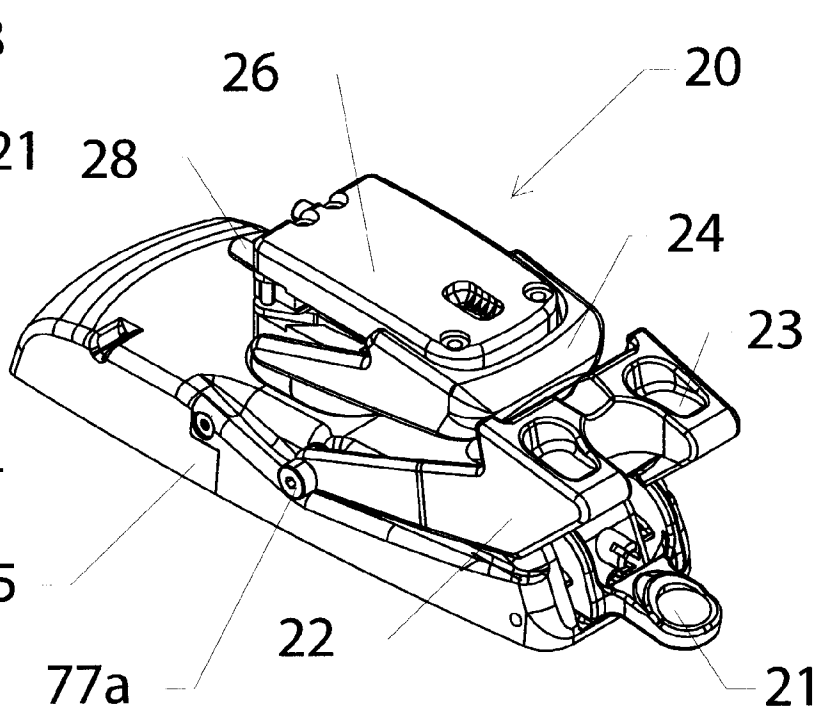
FIGS. 6A and 6B are perspective views of a heel lift of this invention.
Figure 6A:
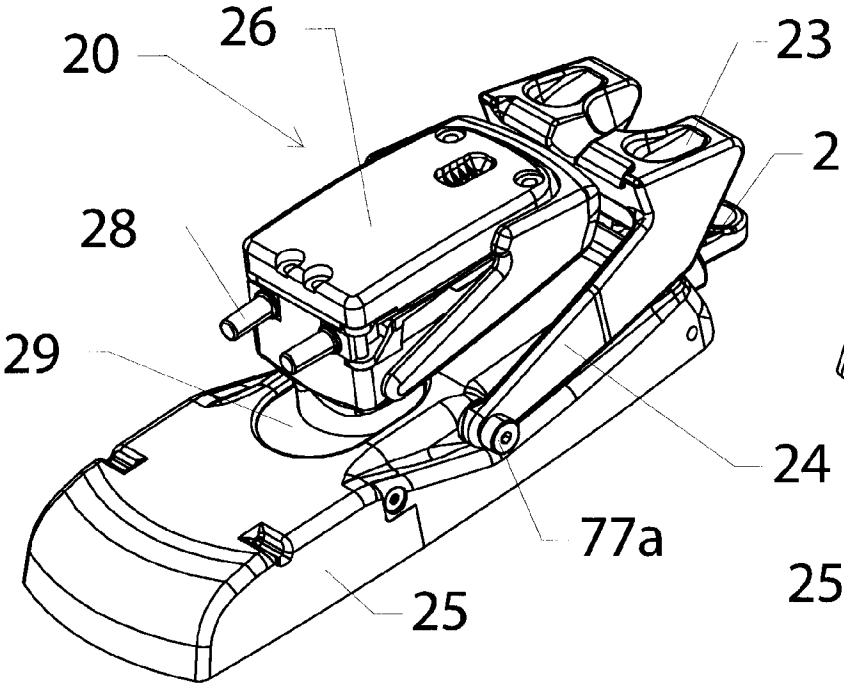

FIGS. 5A and 5B illustrate particular embodiments of this invention which provide for heel lift when in the touring mode. Heel unit 20 is mounted to the upper ski surface through a base plate (not shown) which is covered by cover 25. Upper portion 26 comprises a housing that contains pins 28 which are intended to engage a boot heel (not shown). Heel unit 20 shown in FIGS. 5A and 5B is in a downhill mode position, with upper portion 26 having been translated forward relative to cover 25. To move upper portion 26 in a rearward direction to switch to the touring mode, the user depresses lever 21. This can be conveniently done with a ski pole tip. Low heel support 22 and high heel support 24 are independently, pivotally engaged with the heel unit. Low heel support 22 is pivotally fastened to cover 25 with screw 77*a* which thereby pivotally couples the heel support to the base of the heel unit which in turn is mounted to the snow travel aid. In this embodiment, low heel support 22 contains depressions 23 which are adapted to receive a ski pole tip. FIGS. 6A and 6B illustrate this embodiment in a touring mode position as noted by the size of space 29, as compared to FIG. 5A. This space shows that upper portion 26 of heel unit 20 has been translated rearward relative to cover 25 in FIG. 6A. Lever 21 is in the depressed position. In this embodiment, low heel support 22 also functions as a lever for actuating lever 21 to translate heel unit 20 from the touring mode position illustrated in FIG. 6A back to the ski mode position shown in FIG. 5A. The user accomplishes this by pressing down on the low heel support, for example, by pushing a ski pole tip into depression 23. This action is described in greater detail below with regard to FIGS. 10A-10C.

Figure 7B:
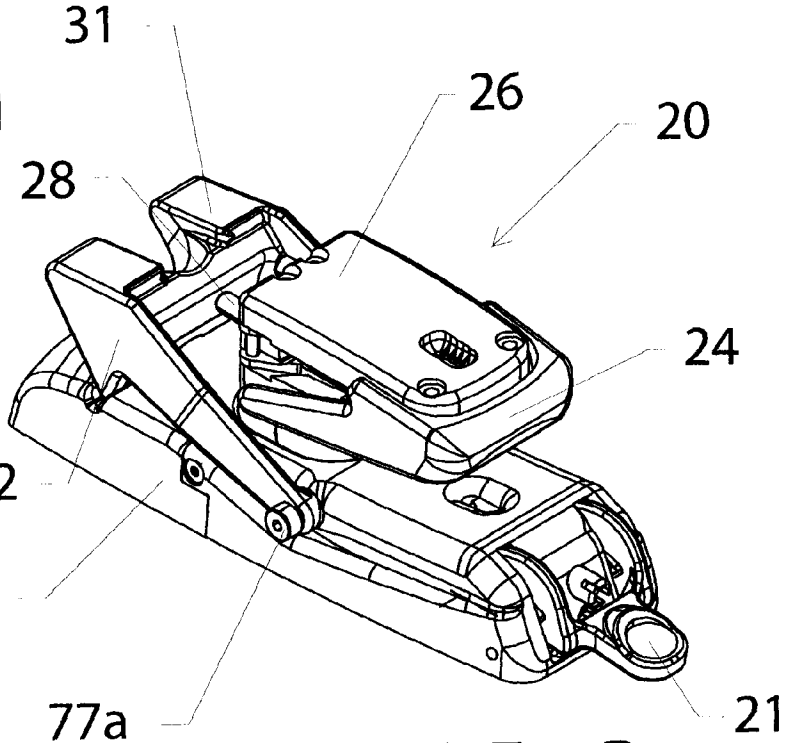
FIGS. 7A and 7B are perspective views of a heel lift of this invention.
Figure 7A:
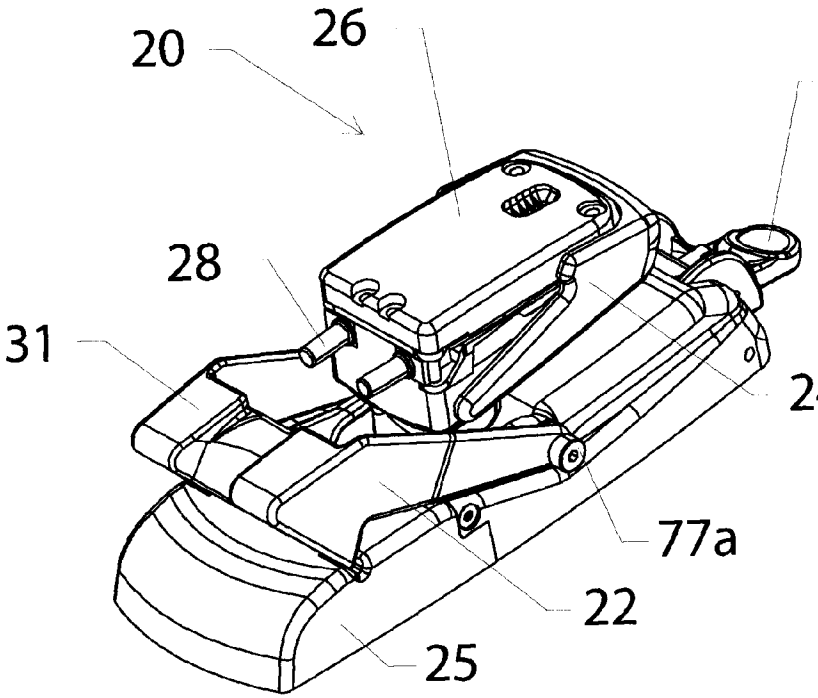
Figures 8A, 8B:
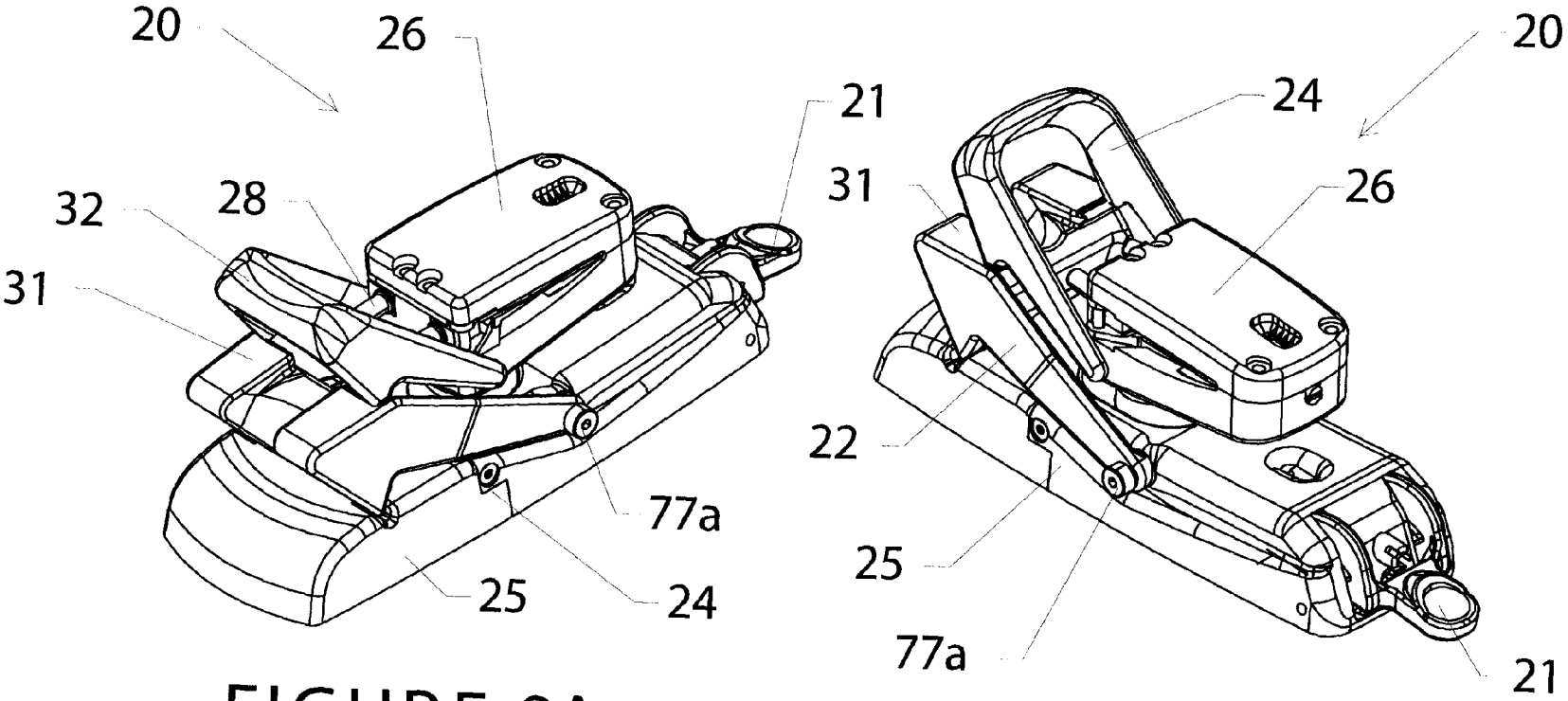
FIGS. 8A and 8B are perspective views of a heel lift of this invention.

When in the touring mode position illustrated in FIGS. 6A and 6B, the user may place a ski pole basket underneath a rearward portion of low heel support 22 and pull the pole forward, causing the heel support to swing forward to a deployed position as illustrated in FIGS. 7A and 7B. The boot heel may now come to rest on surface 31 of low heel support 22. This action also exposes a rearward portion of high heel support 24 thereby allowing the user to use a ski pole basket in a similar fashion to pivot the high heel support to a forward position, as illustrated in FIGS. 8A and 8B. In this position, the boot heel may come to rest on surface 32 of the high heel support lever, providing for an optional high lift of the boot heel when climbing very steep slopes.

In various embodiments, the low heel support is configured so that it will not reach its fully deployed position unless the heel unit is in the touring position.

In some embodiments, the overall length of the low heel support may be such so that when in the touring position, the support rests on or engages with pins 28 rather than being positioned forward of these pins as shown in FIG. 7A. Such an arrangement can protect the pins and help prevent a build-up of snow or ice around the pins while touring. In such an embodiment, the high heel support may also be configured so that it will rest on top of the low heel support in a manner similar to that shown in FIG. 8A, when in use.

Figure 9:
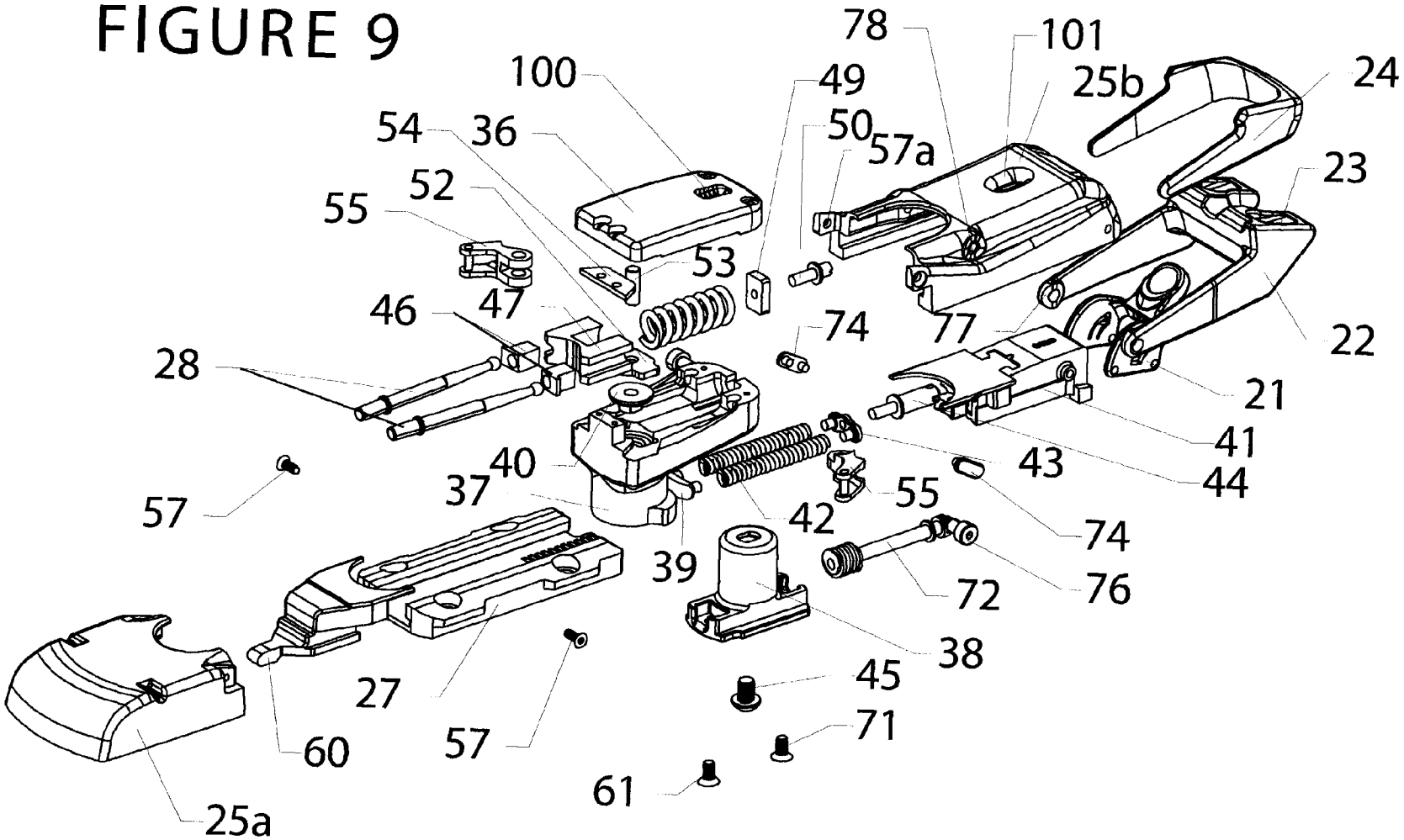
FIG. 9 is an exploded view of a heel unit of this invention.

FIG. 9 shows components of the heel unit illustrated in FIGS. 5-8. The heel unit comprises base plate 27 which contains through-holes for fasteners used to mount the base plate to a snow travel aid. The base plate contains a channel that accepts opposing flanges on the bottom of hollow heel post 38 so that the heel post will be in sliding engagement with the base plate. Coaxially and rotatably mounted on the heel post is heel body 37, the outer periphery of which bears two lobes (one not shown) which, upon rotation of heel body 37 will independently engage Mz plunger 39. An upper portion of heel post 38 contains a fastener opening, which in this embodiment accepts a correspondingly shaped flange of an internally threaded "no-spin" washer 40. Threaded fastener 45 which is inserted from beneath and inside the heel post to engage washer 40 thereby retaining the heel body onto the heel post while permitting the heel body to rotate relative to the heel post. Coupled by screw 71 in a depression at the rear of heel post 38 is the front end of Mz spring housing 41 which contains one or more Mz springs 42, plunger 39 and adjuster 43. The position of adjuster 43 can be visualised in the assembled binding through window 101. The amount of pre-load compression on springs 42 is varied by Mz adjustment screw 44. In the illustrated embodiment, two springs 42 are present in a side by side arrangement although a single spring may be used. An alternative is to provide a multiplicity of coaxially arranged springs in which case there may be a single coaxial arrangement or a plurality of coaxial arrangements. In these embodiments, the Mz release mechanism is located outside of the rotating component of the heel unit and is longer and more robust than in the prior art. This allows for a greater range and higher release settings to be employed.

Heel body 37 comprises a housing that contains the My release components and is closed by cover 36. Rotation of heel body 37 allows for Mz release but is not involved in the change between downhill and touring modes. Heel body 37 contains pins that extend forward and are intended to engage the heel of a ski boot when in the downhill mode. Each pin 28 extends through a pin sleeve 46, each of which is biased laterally inward by a release arm 55. The release arms act independent as levers and engage My plunger 47 which is biased by one or more My spring(s) 48 which in turn is held under compression by My adjuster 49 and adjusted by means of adjustment screw 50. The position of the adjuster can be visualised through window 100 in cover 36. Again, a multiplicity of springs 48 may be employed, including those in a coaxial arrangement. Beneath plunger 47 is My pivot support 52 which receives release arm pivot 53 that is part of plate 54. Plate 54 is mounted by fasteners (not shown) at the front of the heel body housing. Pivot 53 receives both release arms 55. It is advantageous if plunger 47 is constrained within the heel body housing so as to minimize movement of the plunger except in forward/rearward directions.

In the embodiment shown in FIG. 9, the cover consists of front cover 25*a* and rear cover 25*b* which will be joined by cover connection screws 57 inserted into apertures 57*a* and 57*b*. Front cover 25*a* covers a front portion of base plate 27 as well as an optional brake latch actuator 60 which is connected by means of screw 61 to a front portion of heel post 38. Translation of heel post 38 forward and backward translates the brake latch actuator beneath front cover 25*a*.

Rear cover 25*b* covers spring housing 41 and retains adjustment screw 72. Screw 72 contains threads that engage a track on the floor of base plate 27 and is used for fine adjustment of the cover relative to base plate 27 to accommodate boot variance and so that pins 28 will be in the correct position for engagement with the ski boot.

Lever 21 is pivotally engaged to cover 25*b* and is connected to spring housing 41 by a pair of links 74. Depression of lever 21 causes spring housing 41, heel post 38, heel body 37 and brake latch actuator 60 to all move rearward to a touring mode position. The linkage provides an "over-centre" arrangement whereby the lever prefers to be in a fully open or a fully closed position, to minimise accidental translation of the ski binding. In this embodiment, low heel support 22 is used as an additional lever to cause lever 21 to rotate upward, thus moving the binding components forward to a downhill ski mode position.

Low heel support 22 is pivotally engaged with rear cover 25*b* and may further comprise fasteners such as heel lift screw 76 for retaining the heel lift in engagement with rear cover 25*b*. In the illustrated embodiment, wedged shaped facets 77 and 78 are located at the point of engagement of low heel support 22. This provides an "over-centre" arrangement which must be distorted during rotation thereby causing the low heel support to be biased towards the opposite ends of its range of motion. A similar arrangement may be provided for high heel support 24, which in this embodiment is pivotally attached to the housing on heel body 37 by compressive forces created by resilience of the heel support material.

Figure 10A:
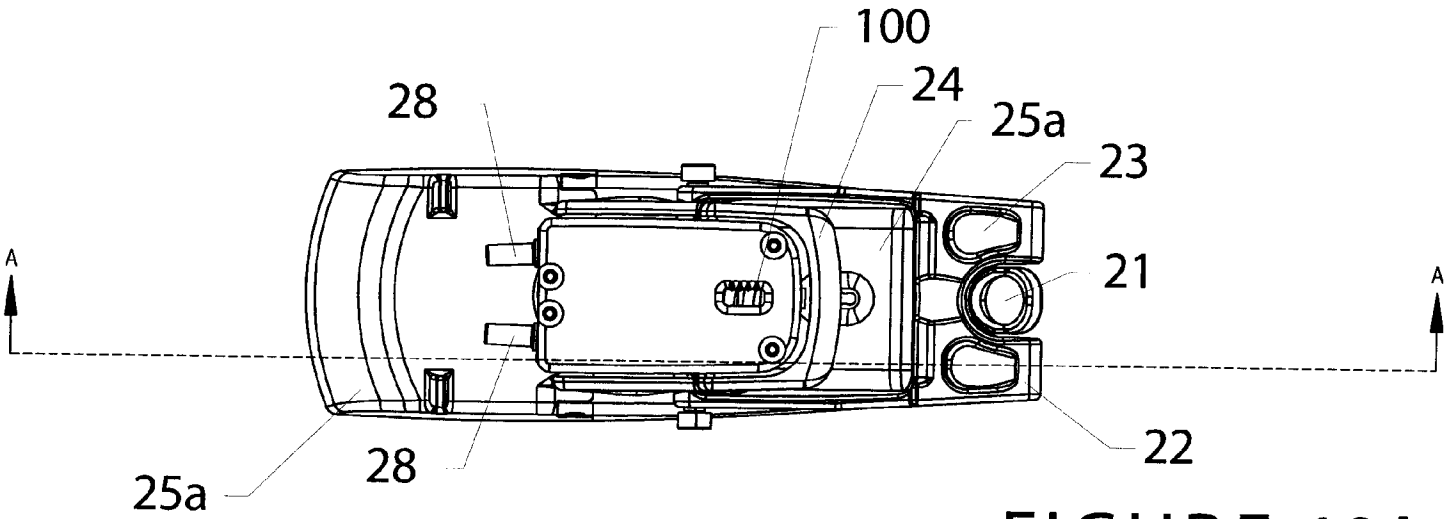
FIG. 10A is a plan view of a heel unit of this invention.
Figure 10B:
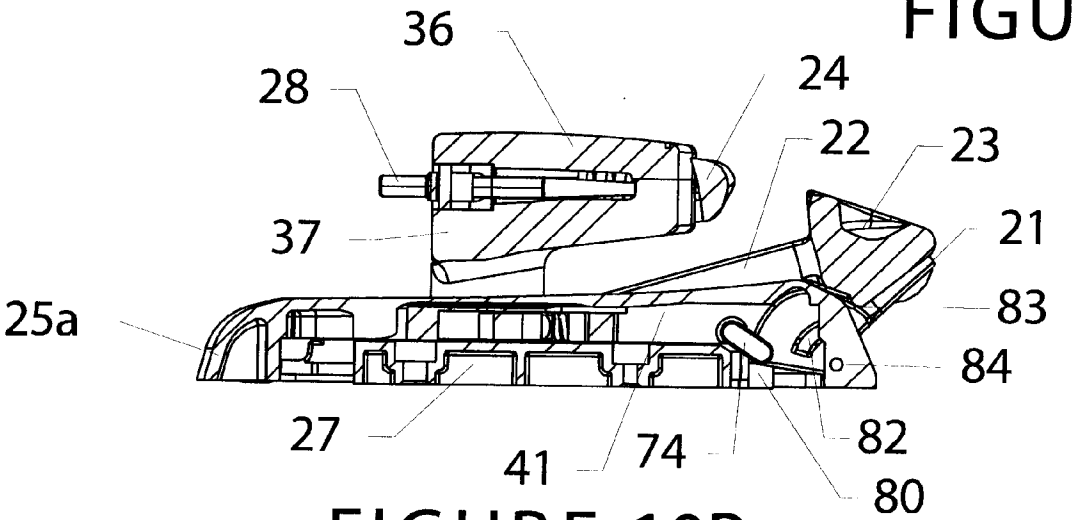
FIGS. 10B and 10C are cross-sectional views taken along line A-A of FIG. 10A in downhill and touring positions, respectively.
Figure 10C:
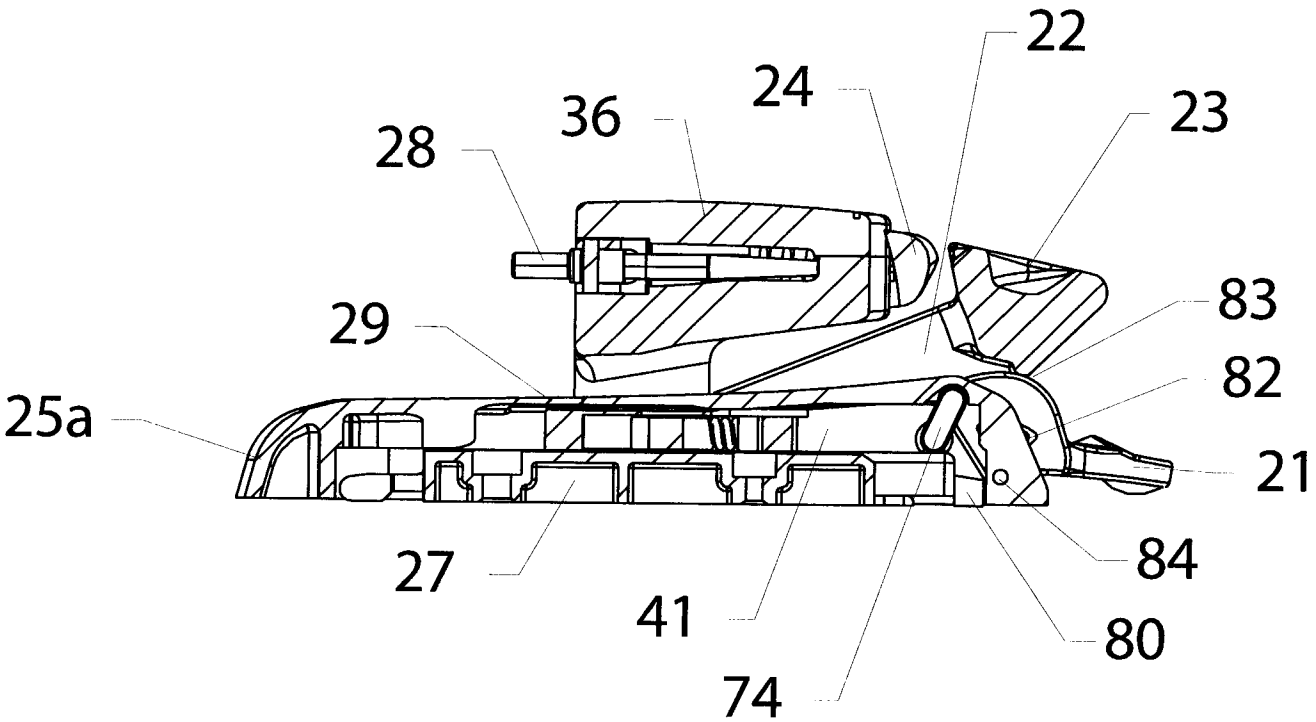

FIG. 10A is a plan view of the heel unit illustrated in FIGS. 5-8. FIGS. 10B and 10C are cross-sectional views taken along line A-A shown in FIG. 10A. In FIG. 10B, the binding is in a downhill mode position with heel body 37 carrying pins 28 translated forward relative to base plate 27. Lever 21 is in an upper position such as is also illustrated in FIGS. 5A and 5B. An upper portion of lever 21 has a curved profile that contacts a lower surface of heel support 22 at point 83. Lever 21 is pivotally engaged with rear cover 25*b* at pivot 84 and is connected to spring housing 41 by link 74. Depression of lever 21 as shown in FIG. 10C results in translation of the heel unit to a position in the touring mode whereby heel body 37 and pins 28 are moved rearward relative to base plate 27 as shown in FIG. 10C. The positions of link 74 shown in both FIGS. 10B and 10C are "over-centre" positions which help to retain the lever at opposite ends of its range of travel. Further retention can be provided by other means such as flexible tab 82 that detent the lever when placed in both ski and tour mode positions. Pressure placed on heel support 22 when in the position shown in FIG. 10C (such as by insertion of a ski pole tip in depression 23) forces lever 21 to return to the position shown in FIG. 10B (a downhill position). This is accomplished by the lower surface of heel support 22 pressing tangentially on the curved profile of lever 21 thereby returning the lever to the ski mode position, rotating link 74 downward and correspondingly translating spring housing 41 and heel body 37 in the forward direction. Rotation stop 80 prevents further downward rotation of lever 21 and link 74 once the heel unit is placed in the ski mode position shown in FIG. 10B.

Figure 11A:
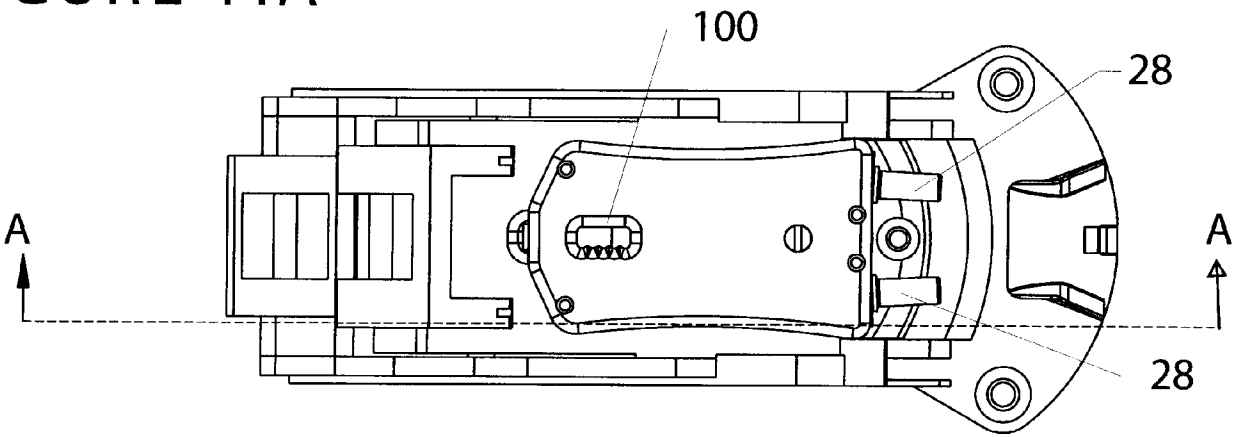
FIG. 11A is a plan view of a heel unit of this invention.
Figure 11B:
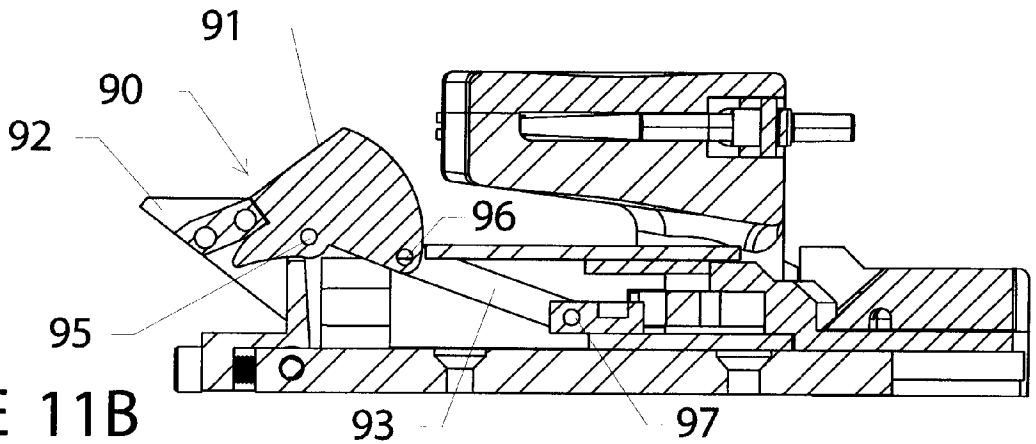
FIGS. 11B and 11C are cross-sectional views taking along line A-A of FIG. 11A in downhill and touring modes, respectively.
Figure 11C:
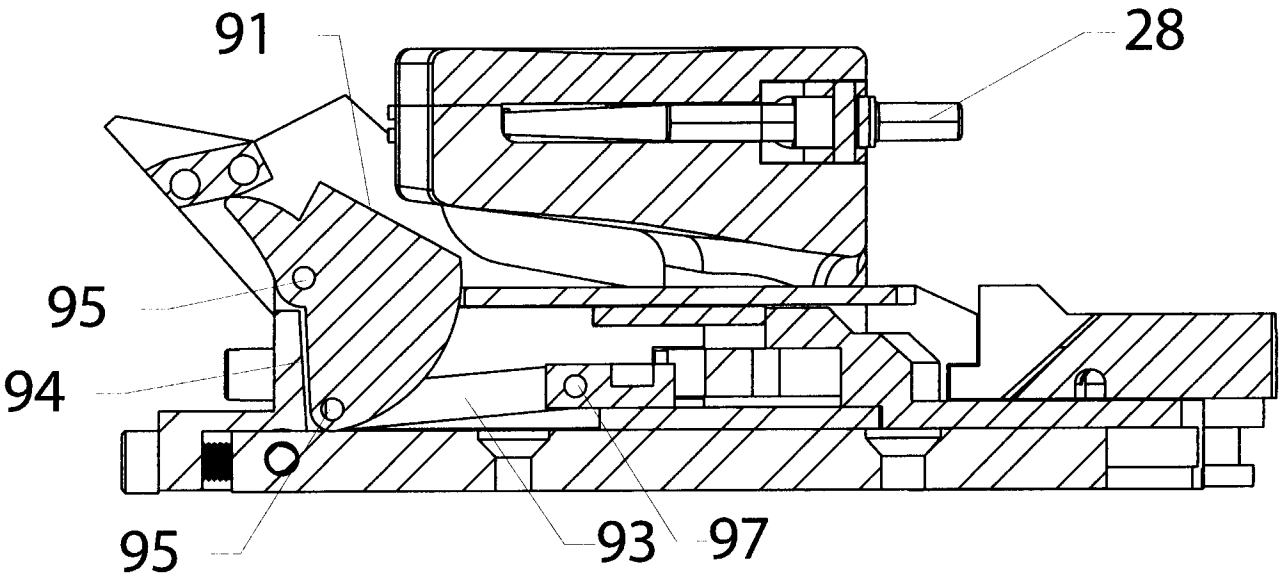

FIG. 11A is a plan view of an alternate embodiment of this invention which employs multiple levers for actuating forward and rearward movement of the binding. FIGS. 11B and 11C are cross-sections of this embodiment taken along line A-A of FIG. 11A. In FIG. 11B, the heel unit is in a ski mode position with pins 28 forward so as to be able to engage the heel of a boot. Pressure applied to the upper surface of lever 91 in FIG. 11B causes link 93 to be drawn rearward, thus moving the binding unit to the position shown in FIG. 11C. Pressure on the upper surface of lever 92 when in the position shown in FIG. 11C, reverses the latter operation and moves the binding components to the position shown in FIG. 11B. Interface 90 provides a rotational stop as does surface 94. In this embodiment, levers 91 and 92 share a common pivot element 95. Lever 91 is connected by pivot 96 to link 93 which in turn is connected by pivot 97 to the sliding portion of the heel unit.

Figure 12A:
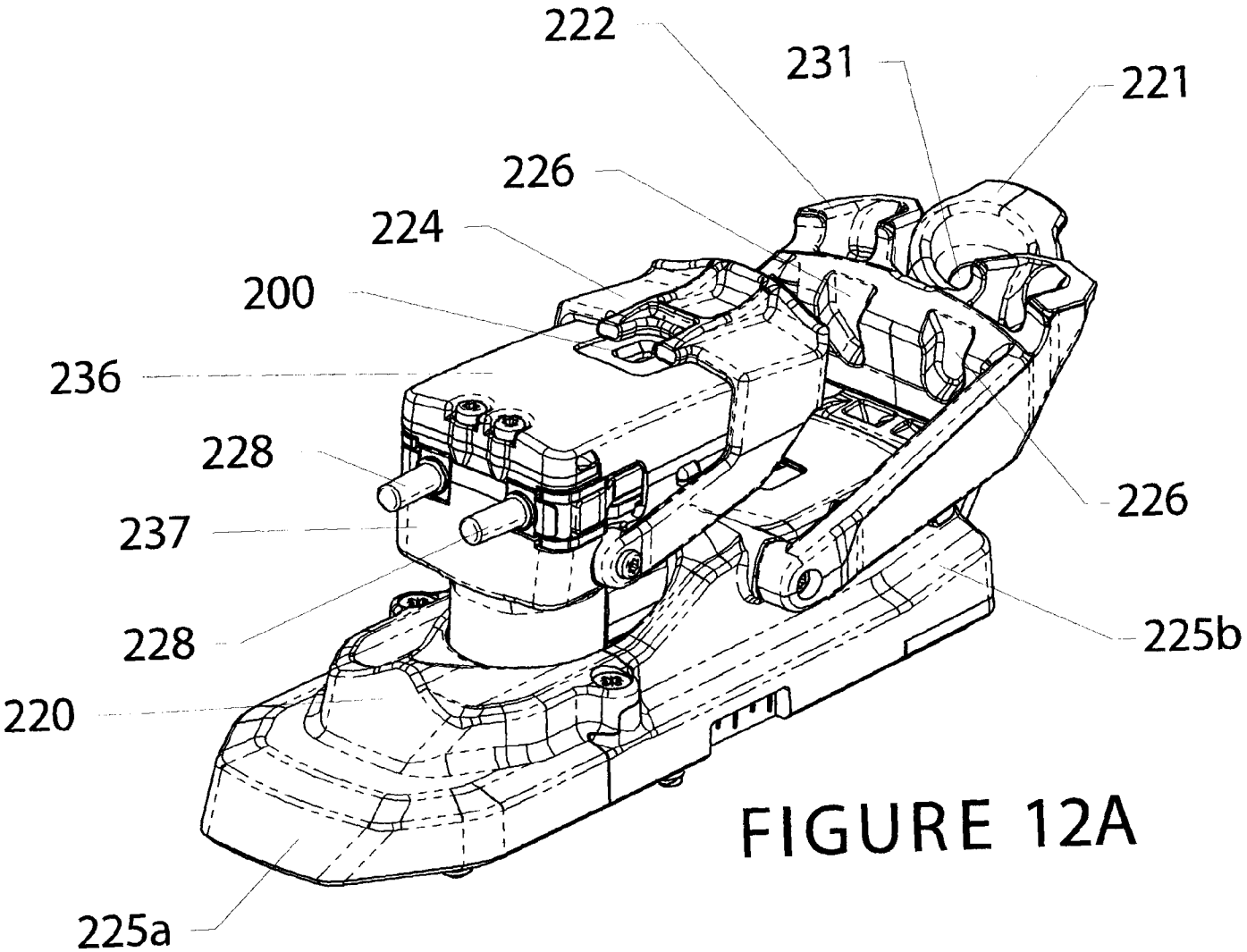
FIG. 12A is a perspective view of a heel unit of this invention.
Figure 12B:
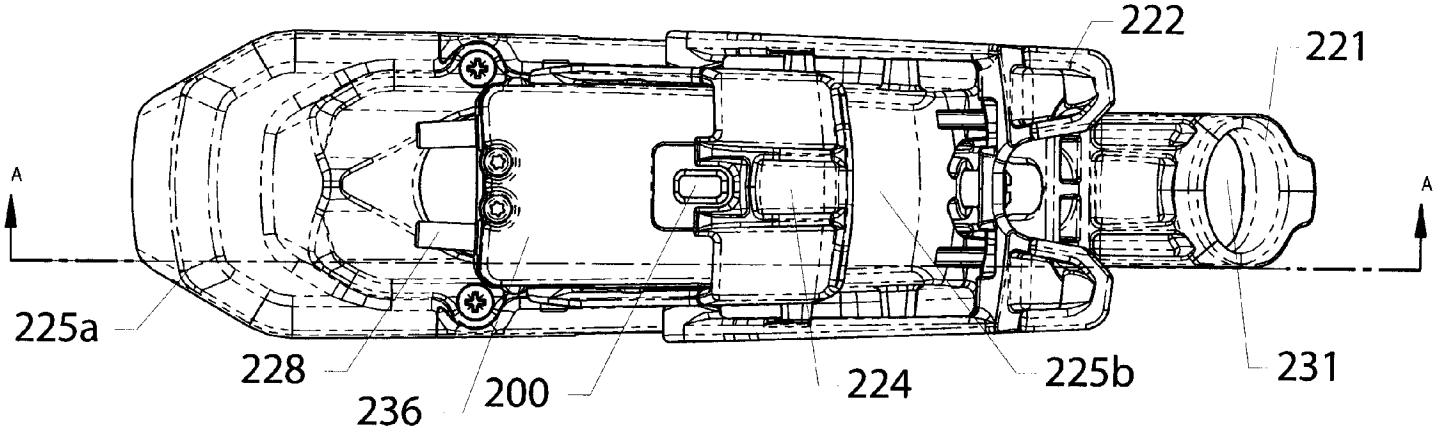
FIG. 12B is a plan view of the latter embodiment.
Figure 12C:
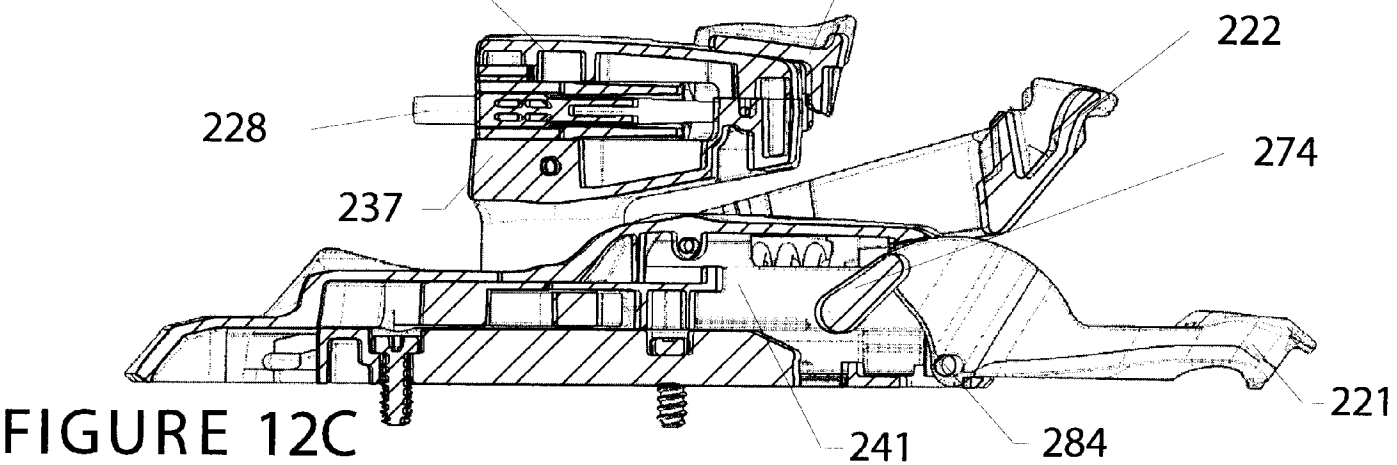
FIG. 12C is a cross-sectional view taken along line A-A of FIG. 12B.
Figure 12D:
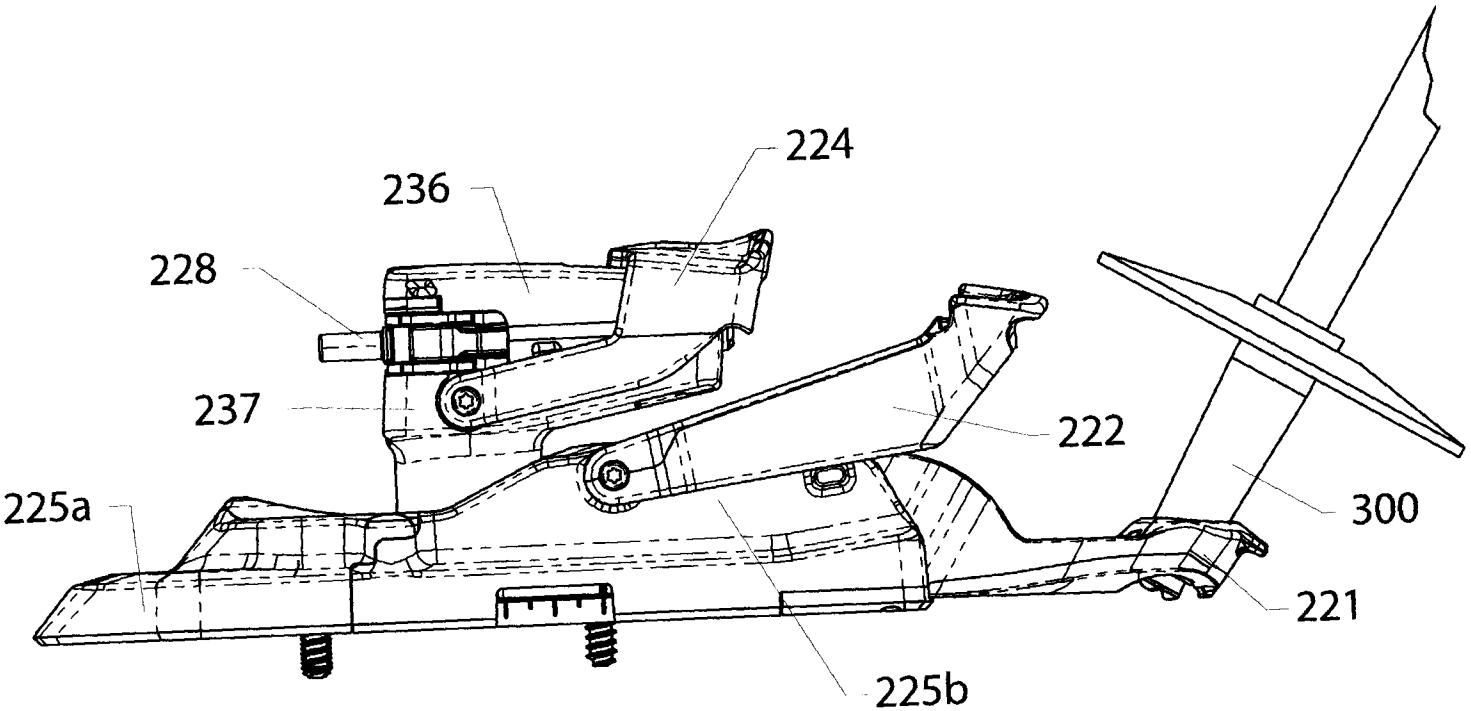
FIGS. 12D and 12E are side views of this embodiment showing the heel unit in touring mode and downhill mode, respectively.
Figure 12E:
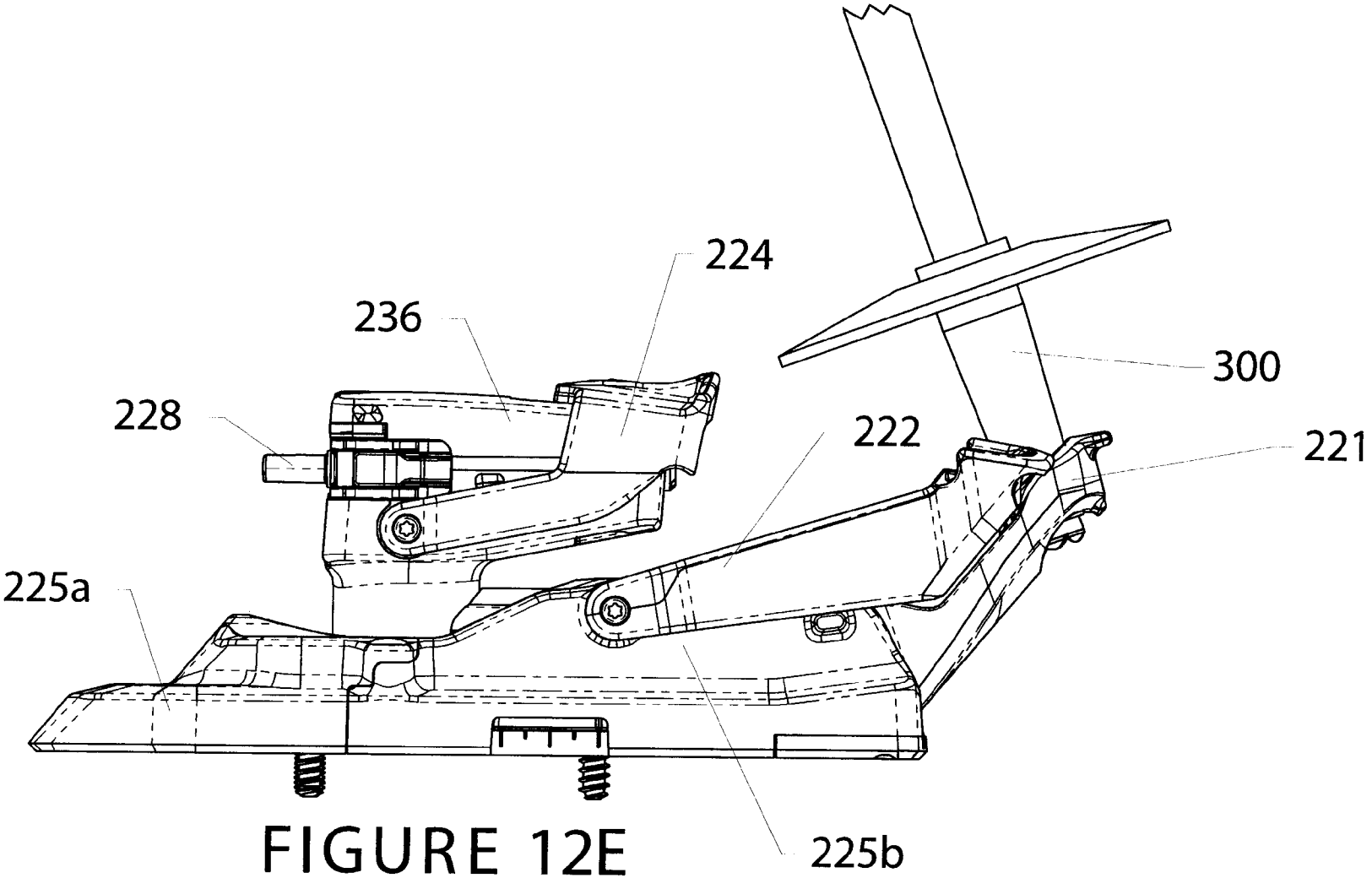

FIGS. 12A-12E illustrate an alternate embodiment of this invention employing a single lever for actuating forward and rearward movement of the binding. This embodiment shown in perspective view in FIG. 12A includes front cover 225*a*, rear cover 225*b*, heel body 237, a pair of pins 228, cover 236, My adjustment window 200, low heel support 222, high heel support 224, and actuation lever 221. FIG. 12C is a cross-section taken along line A-A illustrated in FIG. 12B which is a plan view of this embodiment. In FIG. 12C, actuation lever 221 is shown in the tour mode position in which heel body 237 is positioned rearward. Lever 221 is articulated with the heel unit at pivot 284 and is connected to spring housing 241 by link 274, in a manner similar to that described above. In this embodiment, the user will either engage a pole tip 300 or other tool in the aperture 321 at the end of lever 221 (as illustrated in FIG. 12D) or will manually engage lever 221, to pull the lever upwards to switch to the ski mode position with heel body 237 translating forward as shown in FIG. 12E. To switch back to the tour mode, the user presses down on lever 221 using (for example) pole 300 placed as shown in FIG. 12E.

The embodiment shown in FIG. 12A contains various features intended to reduce snow and ice build-up while touring. These features include a raised portion 220 in the front cover beneath the pins which helps break up snow or ice build-up at that point. In this embodiment, the overall length of low heel support 222 is shorter than that illustrated in the previous drawings so that the low heel lift will engage with pins 228 when the low heel support 222 is pivoted forward for use. In order to facilitate this, low heel support 222 contains a pair of indentations 226 for engaging the pins.

Figure 13A:
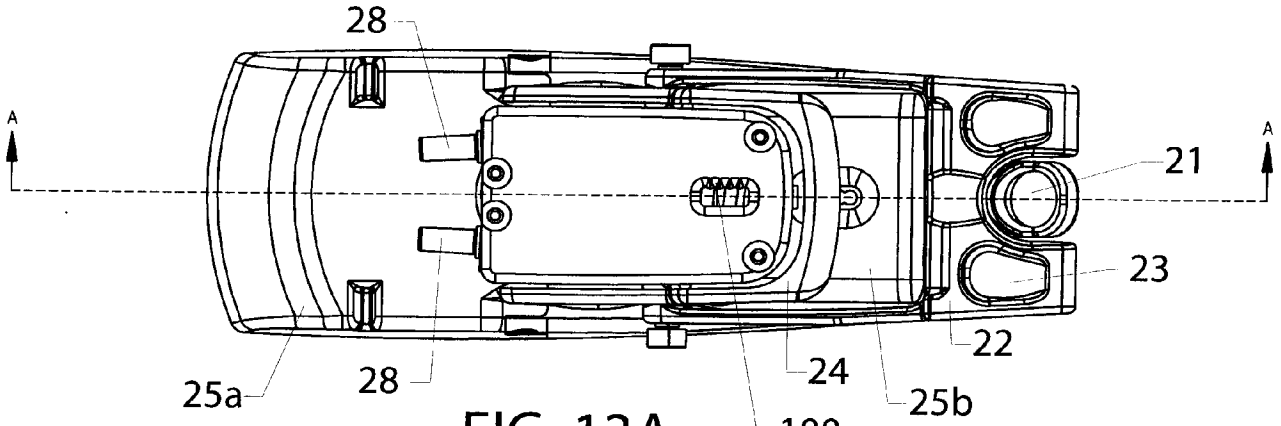
FIG. 13A is a plan view of a heel unit of this invention.
Figure 13B:
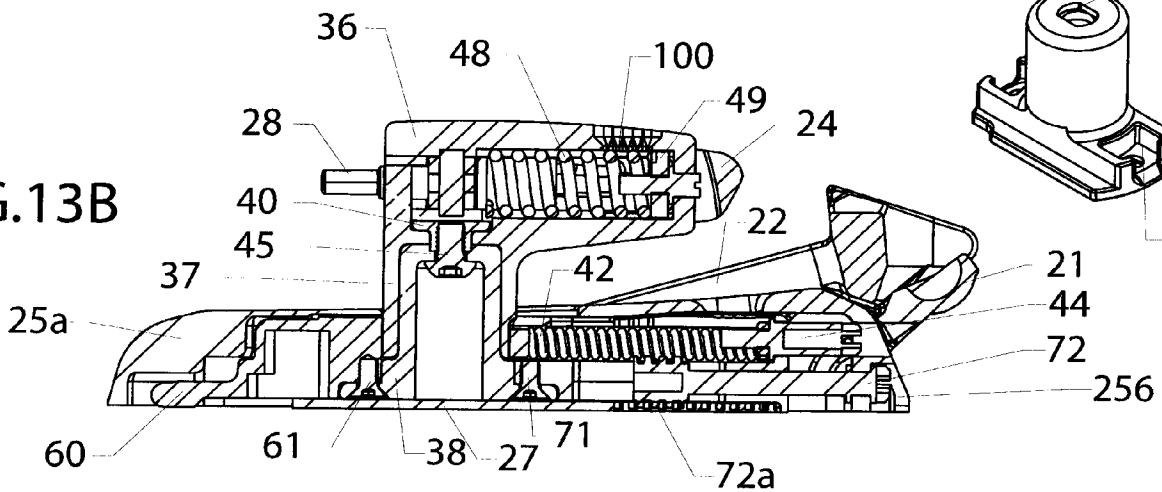
FIG. 13B is a cross-sectional view taken along A-A of FIG. 13A.

FIG. 13A is a plan view of the heel unit shown in FIG. 10A. FIG. 13B is a cross-section taken along line A-A of FIG. 13A and illustrates a coaxial, rotational connection between heel body 37 and heel post 38 which are held together by screw 45 engaged with non-spinning washer 40. This dedicated system for retaining the heel body onto the post independent from the binding release components provides durability and rigidity during skiing.

In FIG. 13B, the location of Mz spring 42 and My spring 48 is illustrated together with their respective adjustment screws 44 and 50. In this embodiment, window 100 reveals the position of My adjuster 49 which serves as a visual indicator of the amount of My spring pre-load. Adjustment screw 72 is shown engaged with rear cover 25*b* and extending to a threaded portion which engages at 72*a* with a rack on the floor of a channel in base plate 27.

Figure 14:
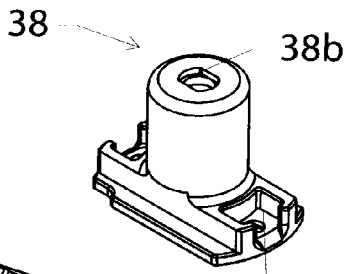
FIG. 14 is a perspective view of a heel unit post for use in this invention.

FIG. 14 illustrates heel post 38 including depression 38*a* that receives the front portion of the Mz spring housing and the screw 71 shown in FIG. 13B. Screw 61 shown in FIG. 13B attaches the opposite side of heel post 38 to optional brake latch holder 60 which is received within front cover 25*a*. Shaped depression 38*b* receives the non-spinning washer 40.

Figure 15B:
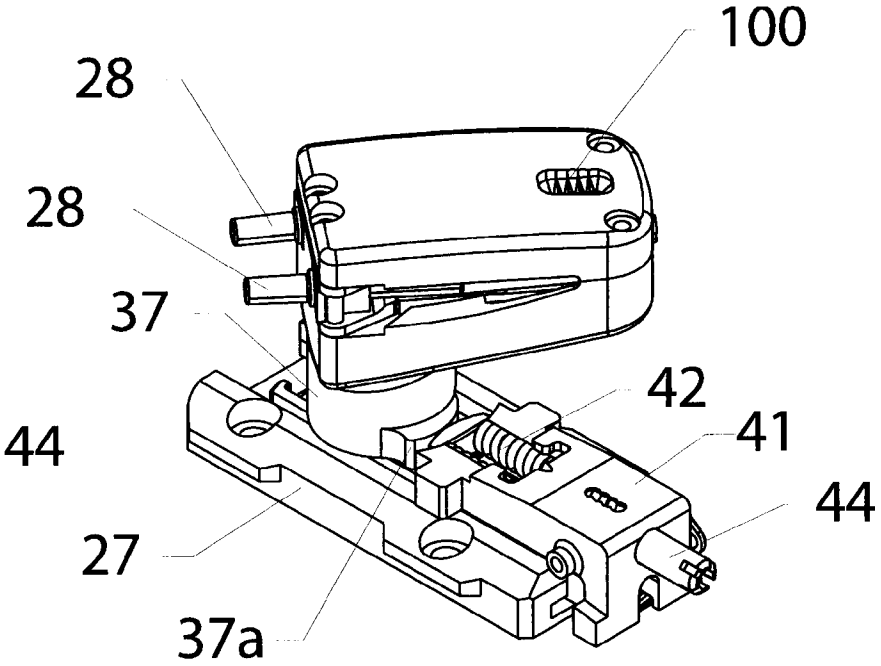
FIGS. 15A and 15B are perspective views of a heel unit of this invention in heel retention and lateral release positions, respectively.
Figure 15A:
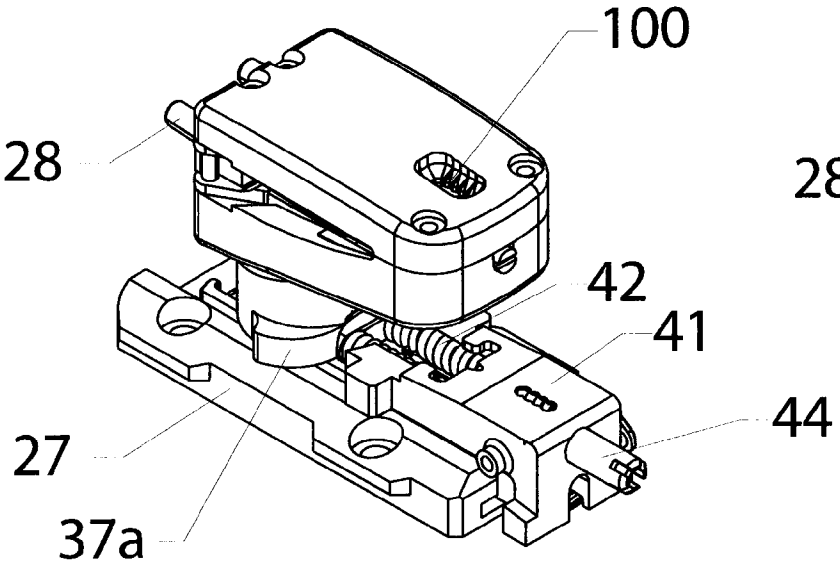

FIGS. 15A and 15B illustrate placement of the Mz release components external to the rotating portion of the heel unit that contain the My release components. This provides for improved strength and durability of the heel post and binding mechanism. Also, a greater range of release values can be achieved through the use of components that are both stronger and larger than what can be accommodated in the upper portion of the heel unit. FIG. 15A illustrates the upper portion of the heel unit engaged with base plate 27 positioned with pins 28 facing forward in the position that they would be in when engaged with the boot. In this position, Mz plunger 39 is biased by Mz springs 42 against a portion on the outer surface of heel body 37 which is straddled by two lobes 37*a* (one not shown) which extend outward from heel body 37. FIG. 15B shows the heel unit rotated in a Mz release position whereby pins 28 would become disengaged from the boot heel. In this position, lobe 37*a* compresses Mz spring 42 through plunger 39. Bias from the spring causes the heel unit to rotate back to the position shown in FIG. 15A once the boot is released.

Figure 16:
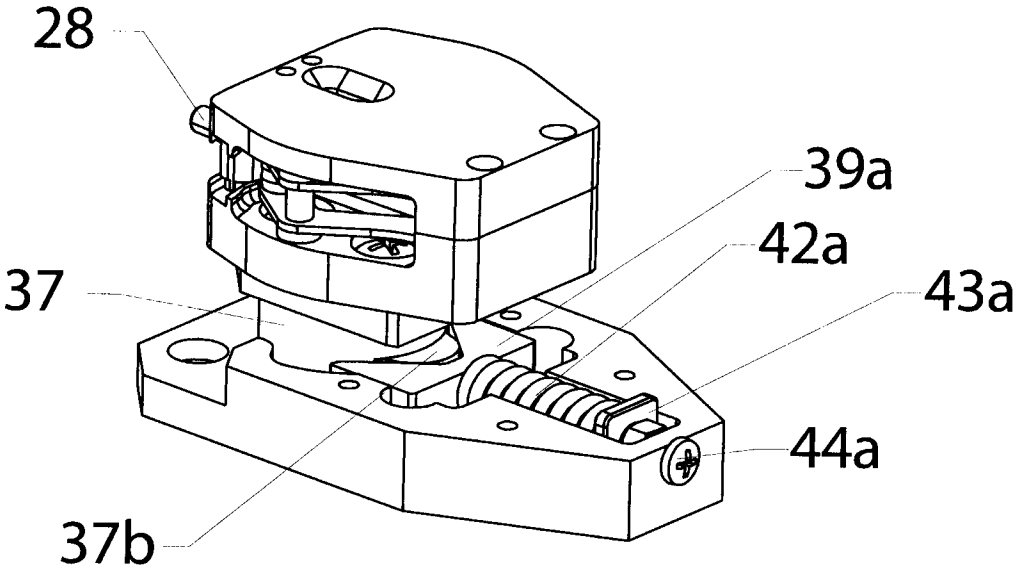
FIG. 16 is a perspective view of an alternate lateral release heel unit of this invention.

FIG. 16 illustrates an alternate Mz release mechanism without the base plate and other binding components. In this embodiment, heel body 37 bears a single cam 37*b* which is engaged between two inclined surfaces of a V-shaped plunger 39*a*. A single Mz spring 42*a* (or a plurality of springs, including coaxially arranged springs) may be provided together with adjuster 43*a* and adjustment screw 44*a*.

Figure 17A:
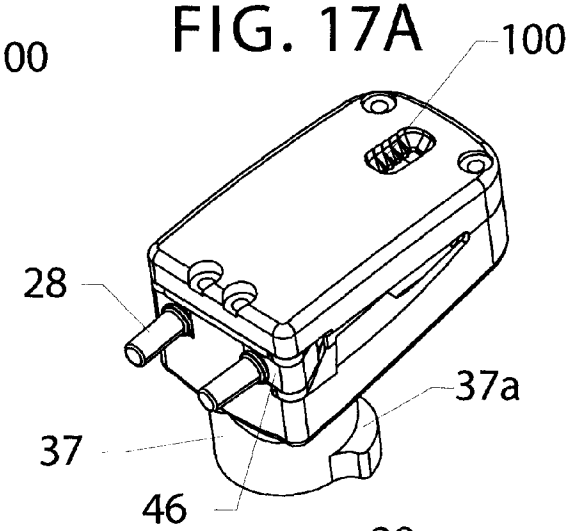
FIGS. 17A and 17D are perspective views of forward release heel units of this invention in heel retention and in heel release positions, respectively.
Figure 17B:
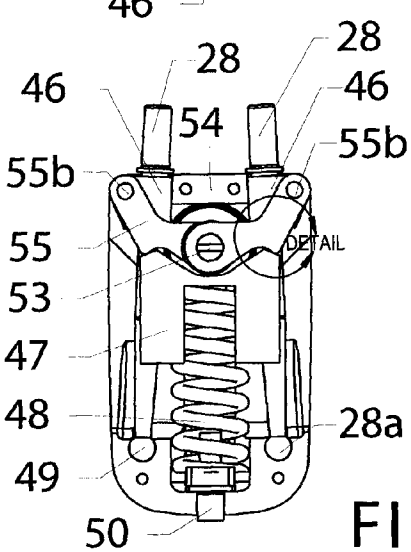
FIGS. 17B and 17E are top views (cover removed) of the devices illustrated in FIGS. 17A and 17D.
Figure 17C:
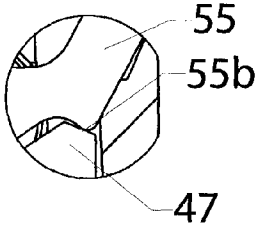
FIG. 17C is a partial plan view of the detail noted in FIG. 17B.
Figure 17D:
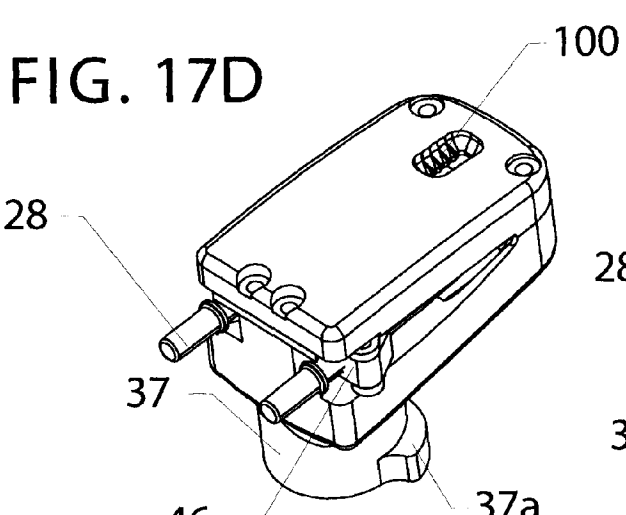
Figure 17E:
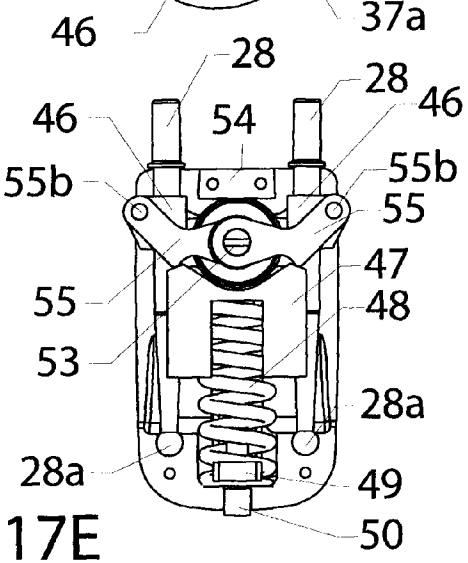

FIGS. 17A-17E illustrate an upper portion of a heel unit of this invention comprising heel body 37 with My release lobe 37*a* shown. FIGS. 17A and 17D show this component with cover 36 containing window 100. FIG. 17A shows pins 28 in their heel holding positions which would engage the footwear heel. FIG. 17D shows pins 28 spread apart as they would be in their release positions. FIGS. 17B and 17E show the device with cover 36 removed. Opposing My release arms 55 function as levers and are pivotally engaged on release arm pivot 53 which is mounted to heel body 37 through support plate 54. Each release arm 55 has two elbows 55*a*, one of which is shown in detailed view in FIG. 17C. The elbows reside above and below the plane of pin 28 and each rests against inclined surfaces spaced apart on the front end of My plunger 47 which is biased forward by means of My spring 48. Pins 28 extend through to ball ends 28*a* which are placed in corresponding sockets in a rear wall of heel body 37. The free ends of pins 28 are biased toward each other because of pre-load on My spring 48 which forces release arms 55 forward such that vertical element 55*b* in the end of each release arm 55 bears against an outer surface of each pin sleeve 46 thereby forcing the forward ends of pins 28 together. FIGS. 17D and 17E illustrate the device under My release conditions whereby the forward ends of pins 28 are forced apart thereby driving at least one of each of pin sleeves 46 against at least one vertical element 55*b* of at least one of the release arms 55 thereby forcing rearward My plunger 47 to further compress My spring 48.

Release characteristics can be tailored during manufacture by adjustment of the shape of the cooperating surfaces of arm 55 and My plunger 47 (such as the angle of the inclined surface of the plunger 47 that intersects an elbow of arm 55 at point 55*a*) as well as by selection of appropriate My spring(s). A wide range of release values may be achieved, including high release values. This arrangement may employ only one My spring, a single coaxial spring arrangement or a plurality of springs or coaxial spring arrangements. Vertical element 55*b* may be a round pin or another element, such as a roller as described below for FIG. 18B.

Figure 18B:
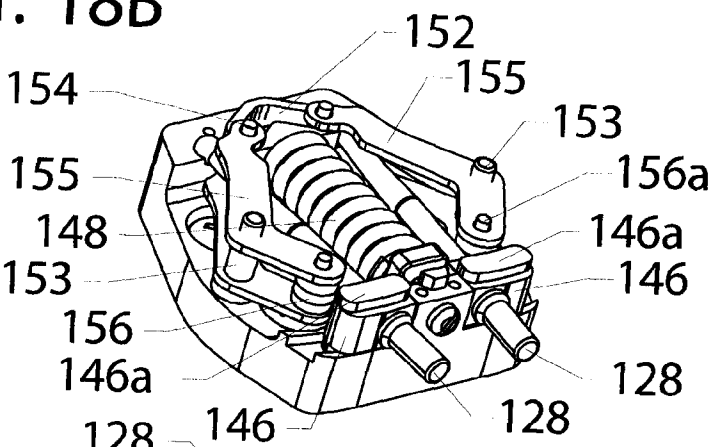
FIG. 18B is a perspective view of the unit shown in FIG. 18A.
Figure 18C:
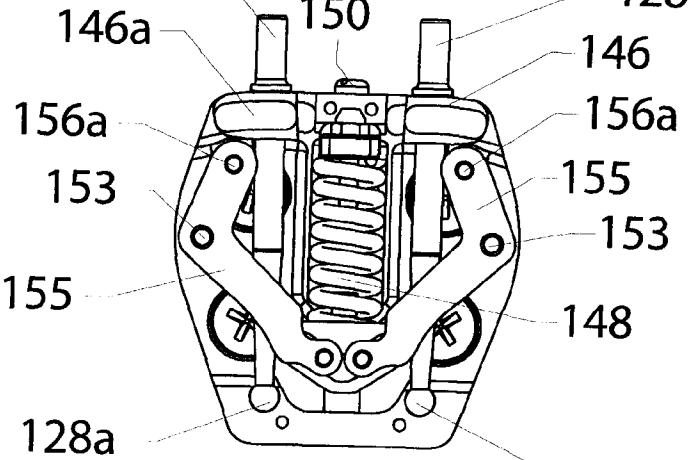
FIGS. 18A and 18C are plan views (cover removed) of alternate forward release heel units of this invention in heel retention and heel release positions, respectively.
Figure 18A:
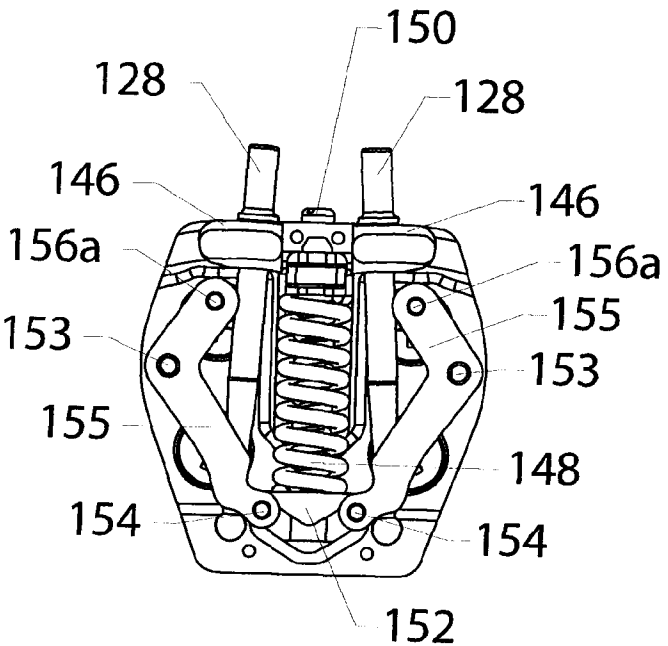

FIGS. 18A-18C illustrate an alternate My release mechanism of this invention that also employs a pair of independent release arms 155 which in this embodiment, act as first class levers with pivot 153 on the housing being the fulcrum. The arms terminate in laterally spaced apart rollers 154 which cooperate with opposing inclined surfaces on plunger 152 which engages a My spring 148. Screw 150 and adjuster 151 are used to apply pre-load to the spring. Pivot 156*a* engages a roller 156 which rests against the outer surface of each of pins 128. Each pin 128 passes through a sleeve 146, each of which contain tabular regions 146*a* for engagement with slots in the housing and cover thereby permitting the sleeves to move back and forth laterally without becoming disengaged from the housing. Pin ends 128 are engaged in sockets in a rear wall of the body as in the previous embodiment. Pins 128 are shown spread apart in a release position in FIG. 18C, causing spring 148 to be further compressed. In this embodiment, sleeves 146 slide from side to side but do not move rearward when the pin is forced outwards. Rollers such as those shown in FIG. 18B may be used in other embodiments, such as those shown in FIGS. 17 and 19 to directly engage a side of the pin or to engage a sleeve. Also, in some embodiments, the outer surface of a sleeve that engages with a release arm may be inclined such that the sleeve is tapered toward the rear of the pin. The amount of taper may be adjusted to alter release characteristics.

Figure 19A:
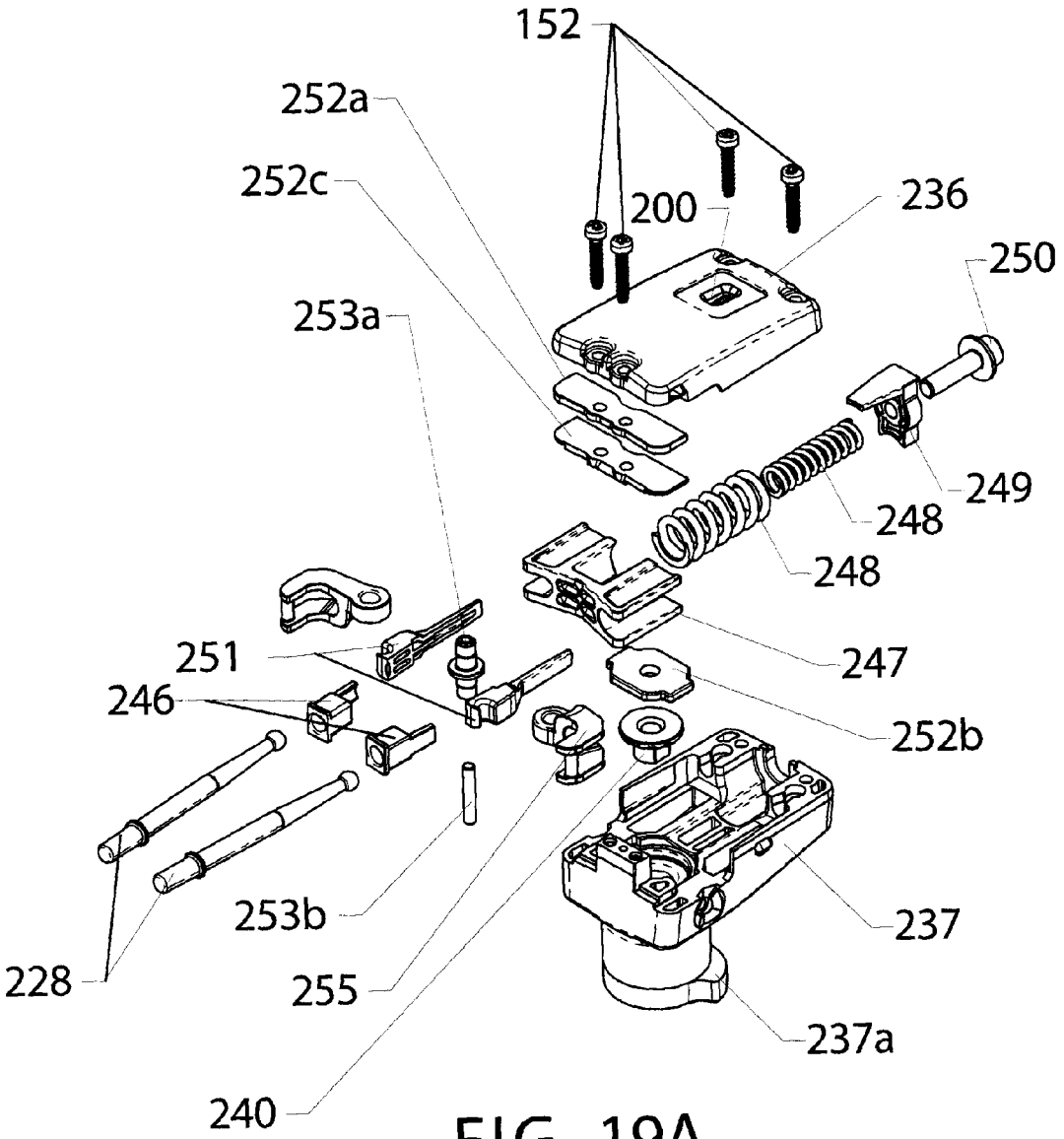
FIG. 19A is an exploded view of an alternate forward release heel unit of this invention.
Figure 19B:
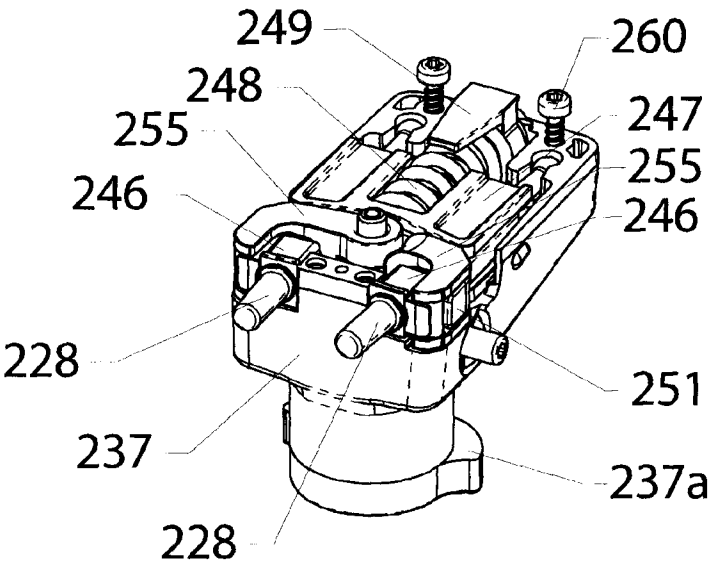
FIGS. 19B and 19C are perspective views of the assembled unit shown in FIG. 19A (cover removed) in boot retention and forward release positions, respectively.
Figure 19C:
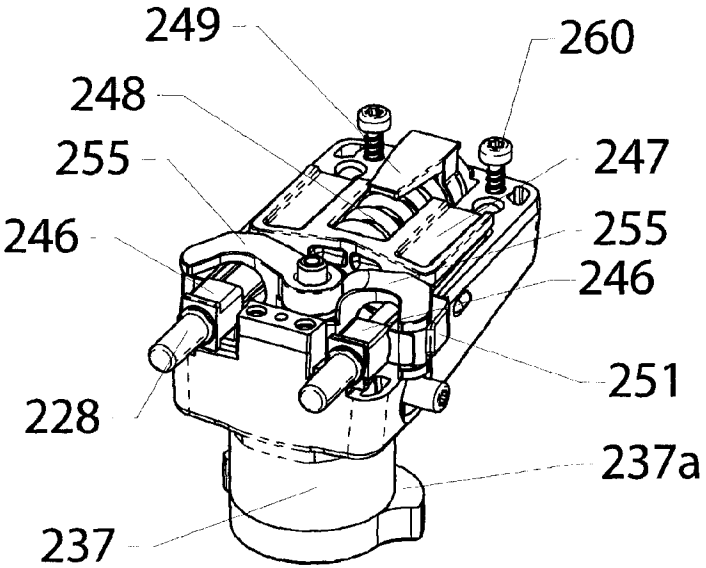

FIG. 19A shows components of an alternate heel body and My release mechanism of this invention. This embodiment comprises heel body 237, My release lobe 237A, no-spin washer 240, release arm bushing 253*a* and bushing dowel pin 253*b*, a pair of independent My release arms 255, a pair of release pins 228, a pair of coaxially engaged My springs 248, adjustor 249, My adjustment screw 250, cover 236 with My adjustment window 200, My pivot support plates 252*a* and 252*b* together with slide plate 252*c*, My plunger 247, and a pair of pin sleeves 246. In addition, this drawing illustrates screw fasteners 260 which attach the cover to the heel body thereby enclosing the My components and as well, a pair of pin sliders 251. The heel body of this embodiment is shown in partially assembled, perspective views 19B and 19C which show the arrangement of the My components in the closed position (FIG. 19B) and in the open position with the pins spread apart (FIG. 19C). The arrangement of My release components in this embodiment combines certain features described above for preceding embodiments. In this instance, pin sleeves 246 slide laterally from side to side as the pins spread and close but do not move forward or rearward. Pin sliders 251 which contain an arcuate portion for engaging a pin on a release arm translate laterally outwards when the pins are spread and simultaneously move rearward in sliding engagement with a corresponding pin sleeve 246. Rearward surfaces of each release arm 255 engage with laterally separated forward shaped surfaces on My plunger 247. This embodiment makes use of pin sleeves which remain in a forward position to support the release pins while employing the type of release lever arrangement of the embodiment shown in FIG. 17 above. This provides for continued support of the pins at the front of the heel body throughout the forward release cycle.

The My levers described in the various embodiments above are laterally displaced within the heel body and are arranged to contact a plunger at laterally spaced apart points. The use of independent levers on pivots provides for a more efficient transmission of forces than in previous known devices that make use of sliding inclined surfaces. Furthermore, the provision of independent levers placed side by side to engage laterally displaced points on the plunger reduces the likelihood that forward release will occur as a result of lateral displacement of only one pin. This effect is accentuated when provision is made to constrain motion of the plunger within the heel body except when the plunger moves forward or rearward in the linear direction of force.

In the various embodiments of this invention, provision may be made for the presence of cavities, passages and the like within the heel unit for retaining a quantity of lubricant to provide for continued lubrication of moving parts.

Figure 20B:
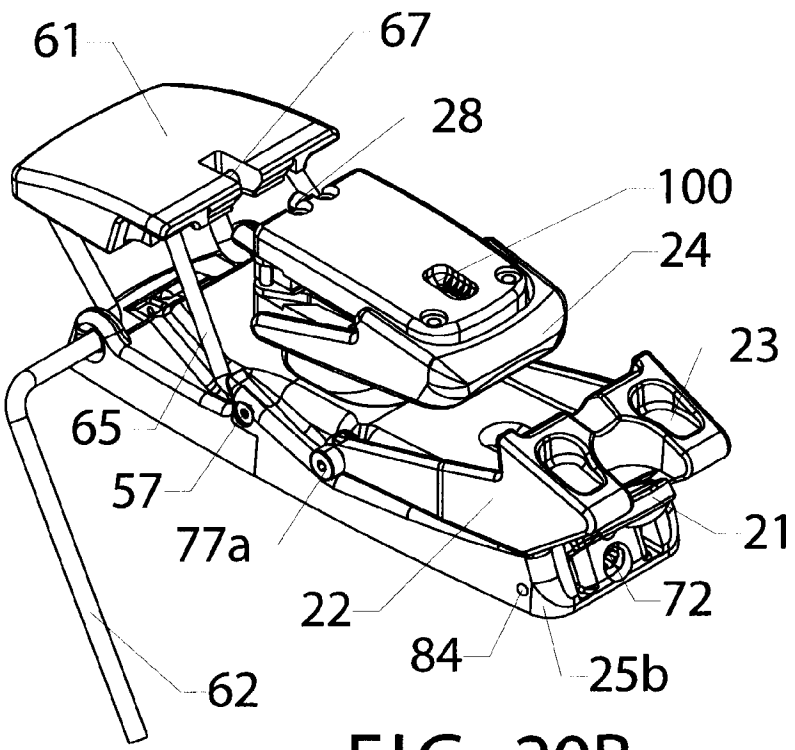
FIGS. 20A and 20B are perspective views of a heel unit of this invention with snow brake deployed in downhill mode.
Figure 20A:
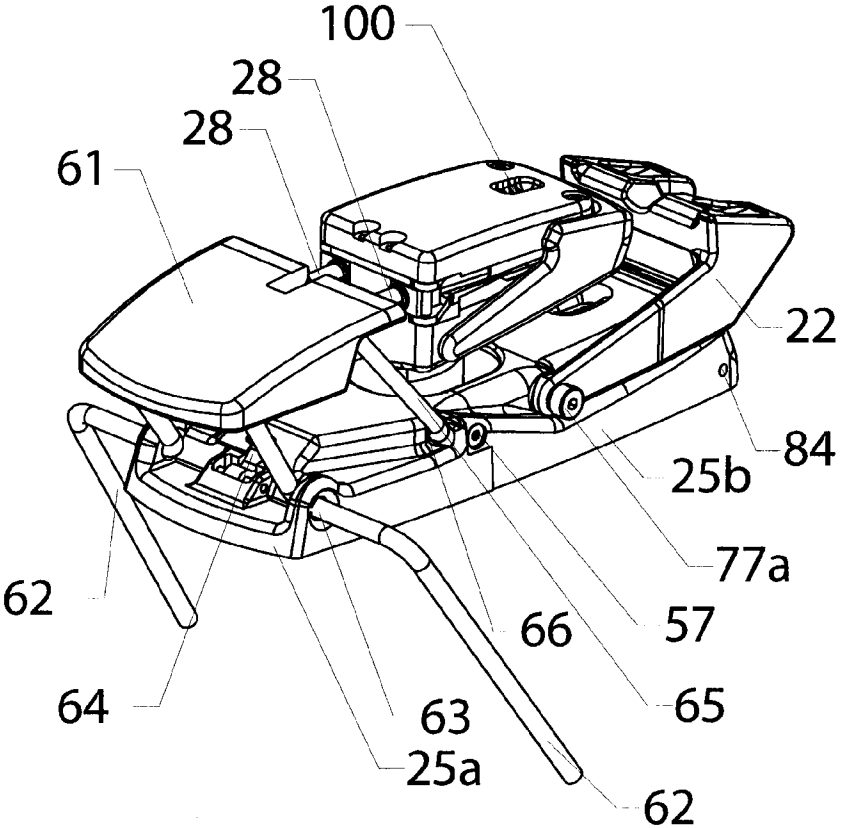
Figure 21B:
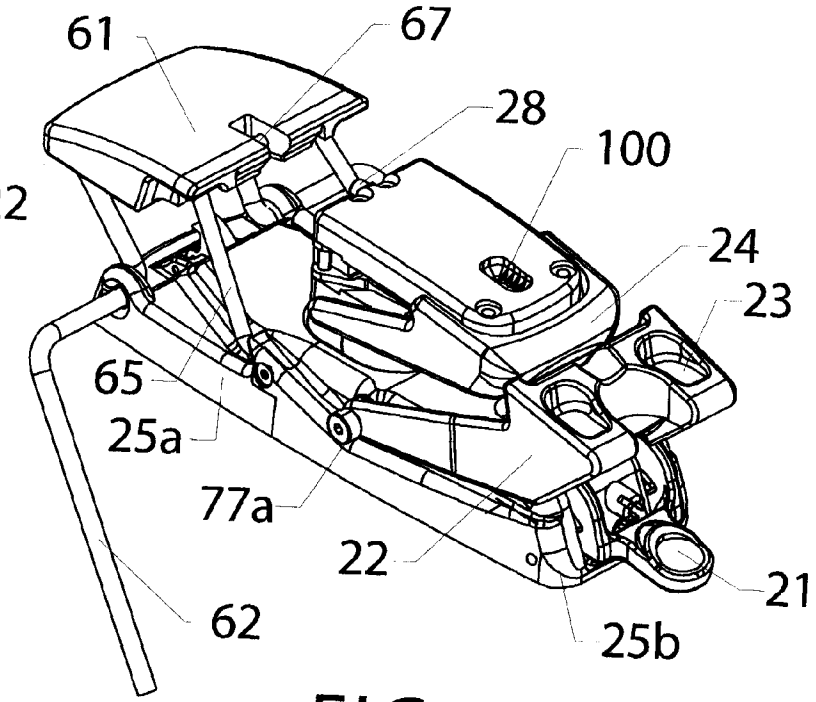
FIGS. 21A and 21B are perspective views of a heel unit of this invention in tour mode with snow brake ready to be locked down.
Figure 21A:
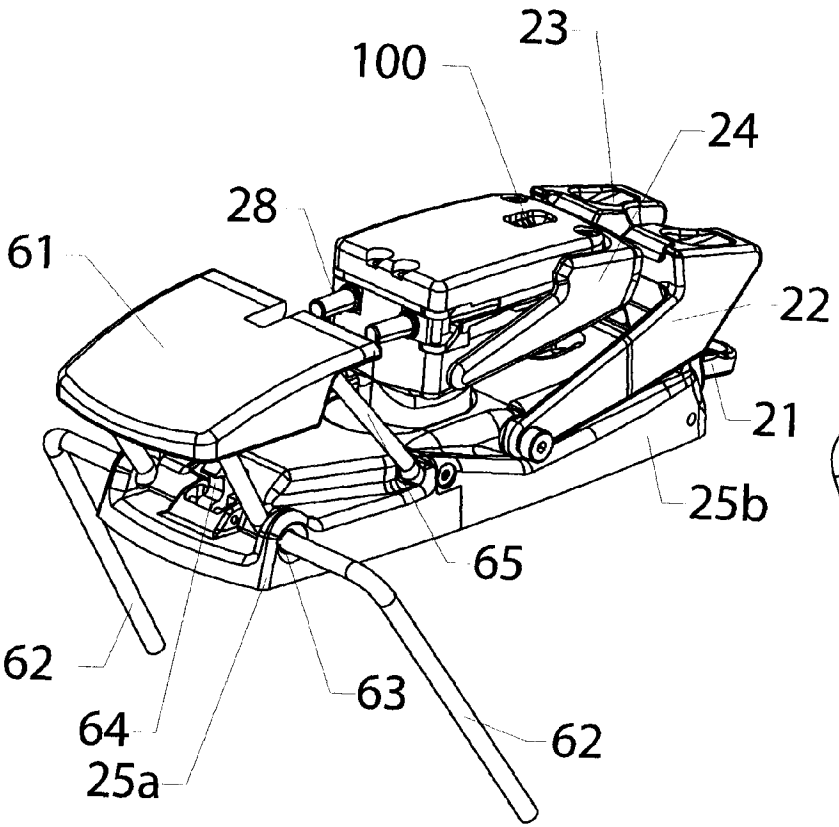

FIGS. 20A and 20B show an embodiment of a heel unit of this invention with integral snow brake. In these drawings, the heel unit is in a downhill mode position such that pins 28 are moved forward and are capable of engaging the heel of a ski boot. When in a downhill mode position, it is necessary for the brake mechanism to be free so that the end of each brake arm 62 will swing downward and contact the snow should the boot be released from the binding. Brake arms 62 pass through apertures 63 on opposite sides of front cover 25*a* and are pivotally attached to a bottom surface of brake platform 61. Ends of brake link 65 extend into openings 66 in the rear cover and the upper portion of the rear brake link is pivotally attached to a bottom surface of the brake platform 61. In downhill mode, hook 64 is positioned so that when brake platform 61 is depressed toward the upper surface of a snow travel aid (thereby raising brake arms 62 from the snow surface) the hook will not engage with the brake platform. However, when in the tour mode position, as shown in FIGS. 21A and 21B, hook 64 is rotated forward such that when the platform is forced downward to raise brake arms 62 from the snow, latch portion 67 of brake link 65 will engage the hook and the brake platform will be retained in a position with brake arm 62 elevated from the snow. Thus, lifting the boot at that point will not cause the brake arm to be released because of engagement of hook 64 with latch 67. One can place the brake of this invention in the tour mode position simply by applying foot pressure when the heel unit is in a tour mode position. Switching the heel unit to a tour mode position can be done before the user steps on the brake platform or it may be done while the platform is in the depressed position.

Figure 22B:
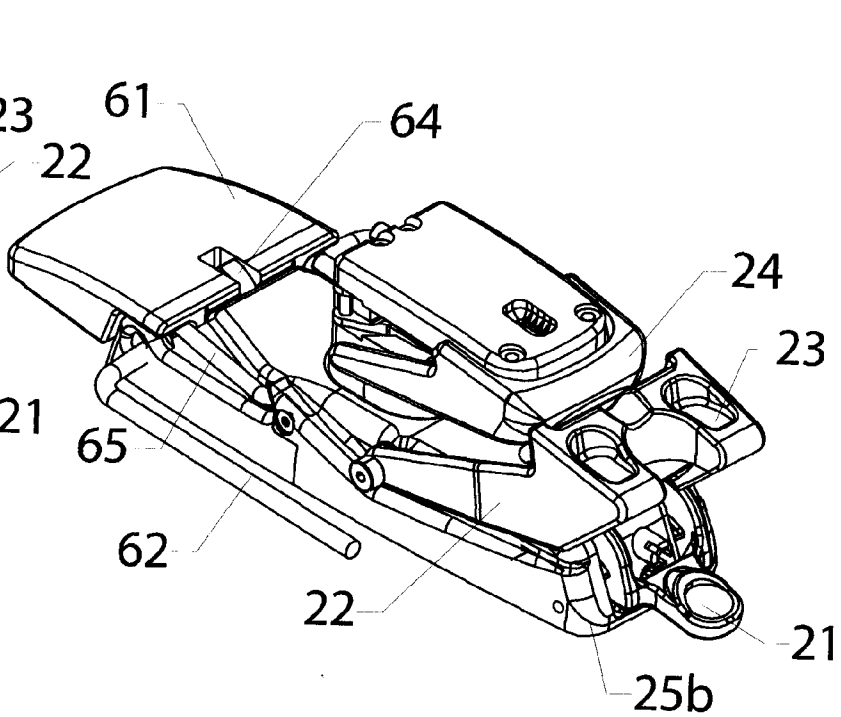
FIGS. 22A and 22B are perspective views of a heel unit of this invention with snow brake in locked position so as to not contact snow.
Figure 22A:
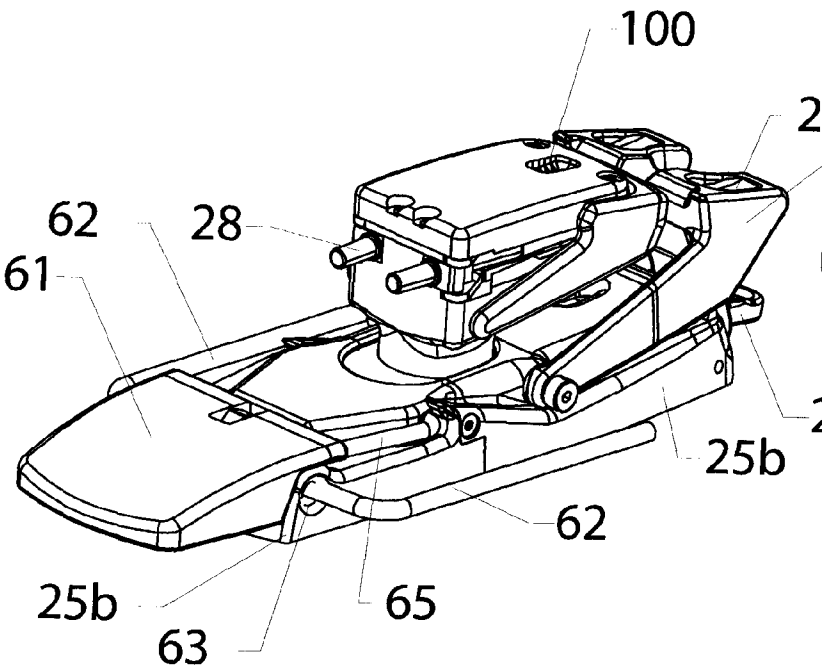

FIGS. 22A and 22B show the brake platform restrained by engagement of hook 64 and latch 67 so that brake platform 61 remains in the depressed position and brake arms 62 are elevated from the snow surface.

Figure 23:
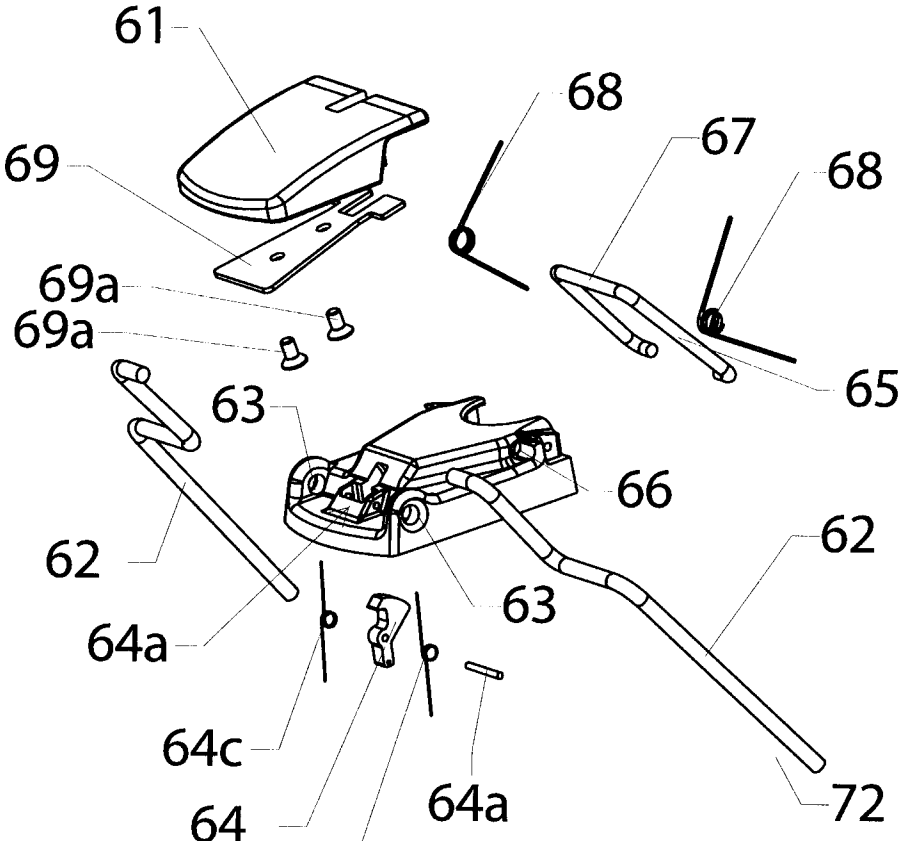
FIG. 23 is an exploded view of a snow brake for use in this invention.

FIG. 23 shows components of a snow brake for use in this invention together with front cover 25*a*. When the optional brake is employed, the front cover 25*a* contain openings 63 and 66 for receiving each brake leg 62 and each of the ends of rear link 65, respectively. In this version, opening 64*d* in the front cover is provided in which hook 64 is pivotally mounted on pivot pin 64*a* and biased in a forward direction by a pair of brake hook springs 64*b* and 64*c*. Upper ends of brake legs 62 and the upper portion of rear link 65 are attached under brake platform 61 by a sub-plate 69 that is fixed to the brake platform by screws 69*a*. Main brake springs 68 bias the brake platform upward from the front cover when the brake is in downhill mode.

Figure 24A:
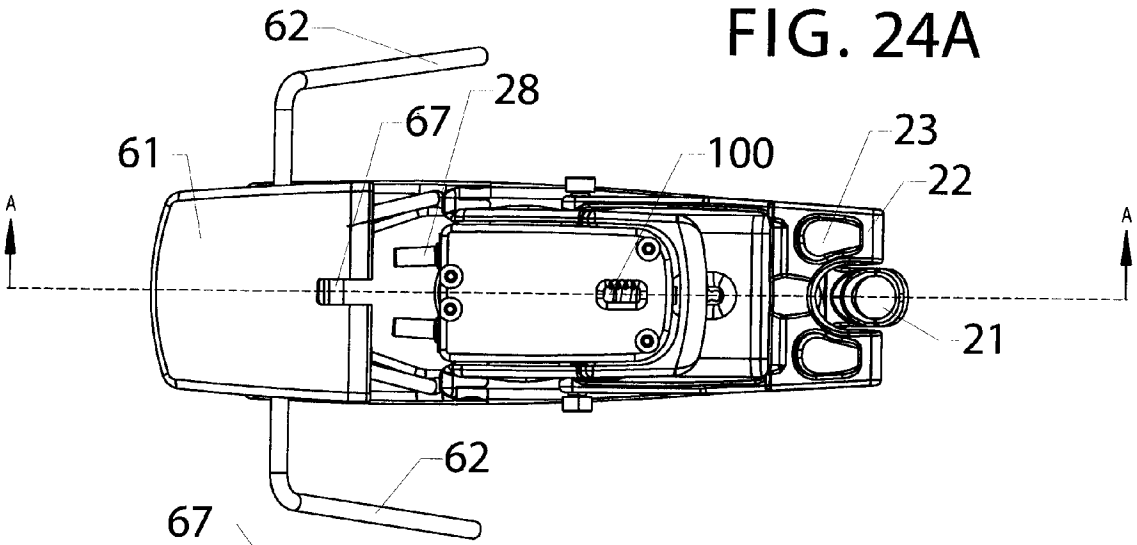
FIG. 24A is a plan view of a heel unit of this invention with snow brake.
Figure 24B:
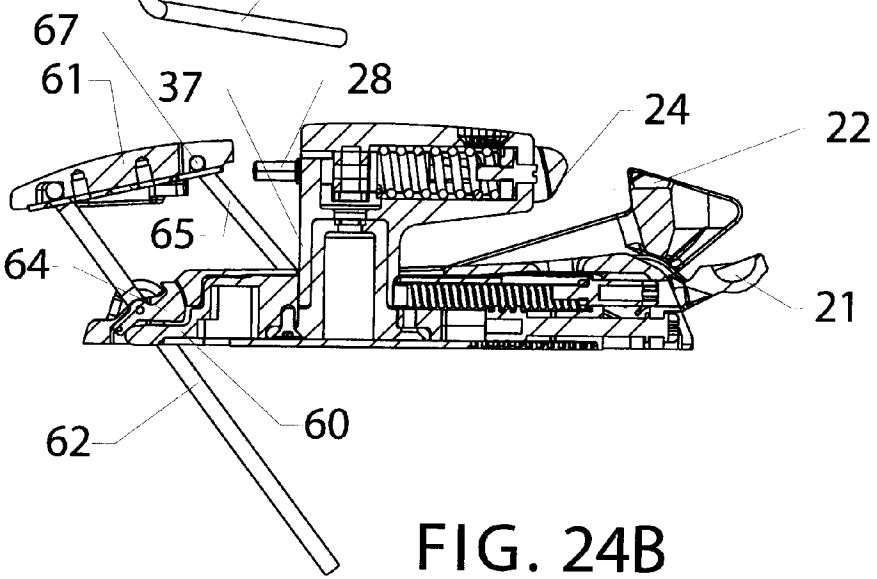
FIG. 24B is a cross-sectional view of the apparatus shown in FIG. 24A in downhill mode with snow brake deployed.

FIG. 24B is a cross-section taken along line A-A of FIG. 24A with the heel unit in the downhill mode position. Brake latch actuator 60 has been forced forward with heel body 37, causing a lower appendage of hook 64 to move forward thereby rotating the hook rearward to a position that will not engage the latch on the brake platform.

Figure 25A:
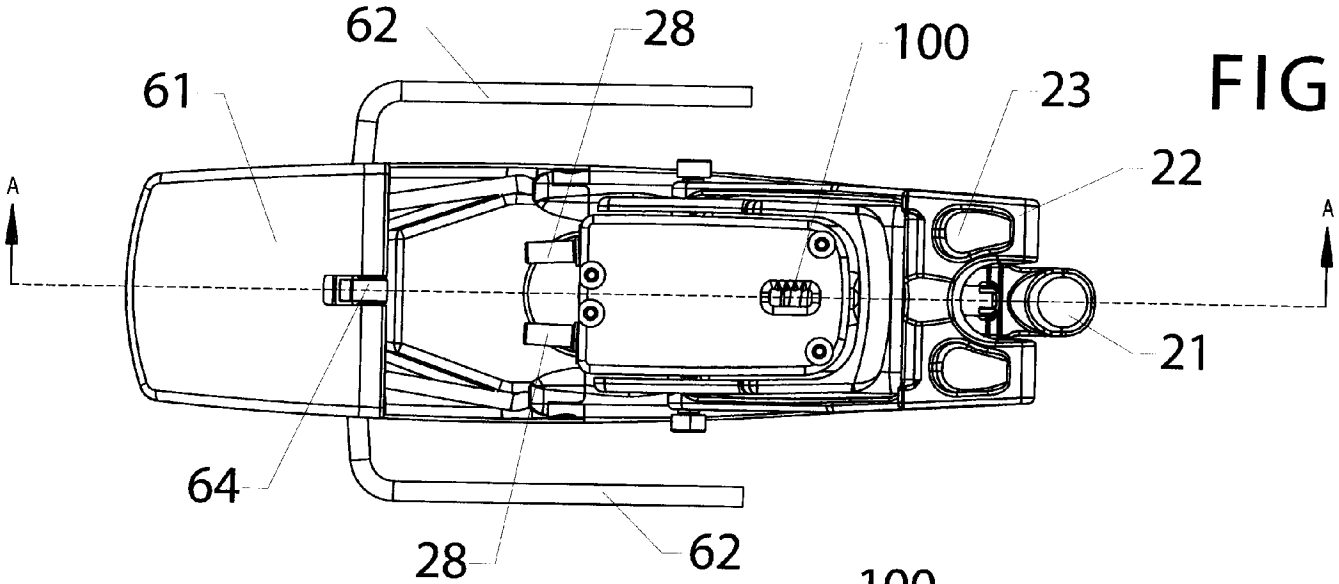
FIG. 25A is a plan view of an apparatus of this invention with snow brake.
Figure 25B:
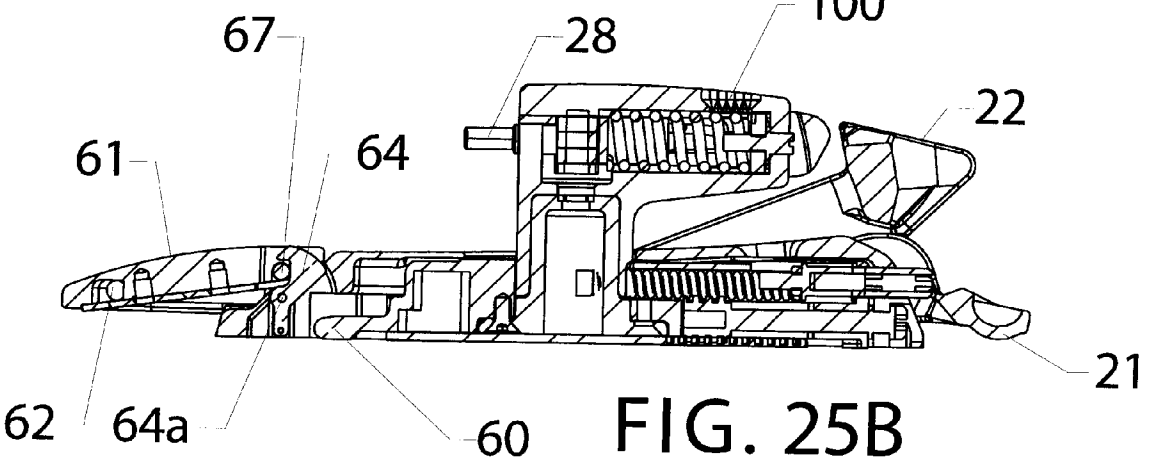
FIG. 25B is a cross-sectional view taken along line A-A of FIG. 25A showing the apparatus in touring position with the snow brake latched down so as to not contact snow.

FIG. 25B is a cross-section along plane A-A of FIG. 25A with the heel unit in a tour mode position. Lever 21 is depressed which has resulted in translation of the binding component in a rearward direction. Brake platform 61 has been depressed so that hook 64 has engaged with latch 67. The hook is retained in this position by the hook springs as illustrated in FIG. 23 and no longer contacts brake latch actuator 60, which has moved rearward along with the binding components. In this position, the brake platform remains close to the ski surface and does not lift when the boot rises during walking or climbing. Brake legs 62 remain generally parallel with the longitudinal axis of the ski and are positioned above the snow surface so as not to impede motion of the ski. Heel support 22 may now be rotated forward to provide for heel lift as described above. This system provides for an automatic latching of the brake platform in a tour mode simply by pressing down with a boot heel plus automatic engagement and disengagement of the latching mechanism when the binding heel unit is moved between the downhill and tour mode positions. Also, the brake function is independent of rotational movement of the heel unit.

In an alternate mechanism to that shown in FIGS. 24B and 25B, a component similar to brake latch actuator 60 moves forward under the front cover forcing a vertically oriented hook to slide forward and be disengaged from a latch on the brake platform. The brake is now free to operate when boot pressure is released from the brake platform. In this position, the hook compresses a spring which, when the binding components are moved to the touring position thereby releasing contact of actuator 60 from the hook, the hook is forced backward to engage with a latch on the brake platform. Thus, in the touring position, the brake platform will become automatically latched when downward pressure is applied with the boot heel.

Although the foregoing invention has been described in some detail by way of illustration and example for purposes of clarity of understanding, it will be readily apparent to those of skill in the art in light of the teachings of this invention that changes and modification may be made thereto without departing from the spirit or scope of the invention. All patent applications and published documents referred to herein are hereby incorporated by reference.

What is claimed is:

1. An apparatus for selectively holding a footwear heel to a snow travel aid, the apparatus comprising:

a base mountable to the snow travel aid; and an upper portion having a connector for connecting the apparatus to the heel;

wherein the upper portion is slidably engageable with the base for controllable movement by a user of the upper portion relative to the base into:

(i) a downhill position whereby the connector would be connected to the heel, and (ii) a touring position spaced rearwardly from the downhill position whereby the connector would be disconnected from the heel;

wherein the apparatus further comprises a brake moveable between a braking position whereby the brake is positioned to contact snow and a raised position whereby the brake would be positioned above the snow and a brake holder moveable in response to movement of the upper portion between the downhill and touring positions, the brake holder for holding the brake in the raised position when the upper portion is in the touring position; and wherein single motions of a lever in opposite directions result in complete movement in opposite directions between the downhill and touring positions.

2. The apparatus of claim 1, wherein the footwear is a ski boot and the snow travel aid is a ski.

3. The apparatus of claim, wherein the brake is pivotably connected to the base and biased towards the braking position and wherein movement of the upper portion into the touring position causes the brake holder to latch the brake when the brake is in the raised position.

4. An apparatus for selectively holding a footwear heel to a snow travel aid, the apparatus comprising:

a base mountable to the snow travel aid; and an upper portion having a connector for connecting the apparatus to the heel;

wherein the upper portion is slidably engageable with the base for controllable movement by a user of the upper portion relative to the base into:

(i) a downhill position whereby the connector would be connected to the heel, and (ii) a touring position spaced rearwardly from the downhill position whereby the connector would be disconnected from the heel;

wherein the apparatus further comprises a brake moveable between a braking position whereby the brake is positioned to contact snow and a raised position whereby the brake would be positioned above the snow and a brake holder moveable in response to movement of the upper portion between the downhill and touring positions, the brake holder for holding the brake in the raised position when the upper portion is in the touring position; the apparatus further comprising a first heel support selectively positionable between deployed and stowed positions, wherein the first heel support is pivotally coupled to opposite sides of the base and straddles the upper portion while pivoting between the deployed and stowed positions; and the apparatus further comprising a second selectively positionable heel support which is supported by the first heel support when both the first and second heel supports are in deployed positions.

5. The apparatus of claim 4, wherein the footwear is a ski boot and the snow travel aid is a ski.

6. An apparatus for selectively holding a footwear heel to a snow travel aid, the apparatus comprising:

a base mountable to the snow travel aid; and an upper portion having a connector for connecting the apparatus to the heel;

wherein the upper portion is slidably engageable with the base for controllable movement by a user of the upper portion relative to the base into:

(i) a downhill position whereby the connector would be connected to the heel, and (ii) a touring position spaced rearwardly from the downhill position whereby the connector would be disconnected from the heel;

wherein the apparatus further comprises a brake moveable between a braking position whereby the brake is positioned to contact snow and a raised position whereby the brake would be positioned above the snow and a brake holder moveable in response to movement of the upper portion between the downhill and touring positions, the brake holder for holding the brake in the raised position when the upper portion is in the touring position; wherein the upper portion is rotatable in opposite directions about a generally vertical axis between two lateral release positions and wherein the connector comprises one or more projections for insertion into one or more cavities in the footwear heel, wherein the one or more projections are moveable between a heel holding position and a forward release position.

7. The apparatus of claim 6, wherein complete movement in at least one direction between said downhill and touring positions is actuated by a single motion of an actuator.

8. The apparatus of claim 7, wherein the actuator is a lever and single motions of the lever in opposite directions result in complete movement in opposite directions between the downhill and touring positions.

9. The apparatus of claim 6, wherein the footwear is a ski boot and the snow travel aid is a ski.

10. A binding kit comprising toe and heel units, each unit for selectively holding footwear to a snow travel aid, the toe unit being configured to function independently from the heel unit to retain the footwear toe on the snow travel aid while permitting forward and rearward movement of the footwear, and wherein the heel unit is an apparatus according to claim 4.

11. A binding kit comprising toe and heel units for holding footwear to a snow travel aid, the toe unit being configured to grip the footwear at only the footwear toe to retain the footwear on the snow travel aid independent of the heel unit while permitting forward and rearward pivoting of the footwear on the snow travel aid and wherein the heel unit comprises:

a base mountable to the snow travel aid; and an upper portion having a connector for connecting with the footwear heel;

wherein the upper portion is slidably engageable with the base for controllable movement by a user of the upper portion relative to the base into:

(i) a downhill position whereby the connector would be connected to the footwear heel, and (ii) a touring position spaced rearwardly from the downhill position whereby the connector would be disconnected from the footwear heel;

wherein complete movement in at least one direction between the downhill and touring positions is actuated by a single motion of an actuator; and wherein the actuator is a lever and single motions of the lever in opposite directions result in complete movement in opposite directions between the downhill and touring positions.

12. The binding kit of claim 11, wherein the single motion of the actuator actuates a device that drives said complete movement.

13. The binding kit of claim 11, wherein the single motion of the actuator drives said complete movement.

14. The binding kit of claim 11, wherein the heel unit further comprises at least one biasing device for urging the upper portion towards at least one of the downhill and touring positions.

15. The binding kit of claim 11, wherein the heel unit further comprises a first heel support selectively positionable between deployed and stowed positions, wherein the first heel support is pivotably coupled to opposite sides of the base and straddles the upper portion while pivoting between the deployed and stowed positions.

16. The binding kit of claim 15, wherein the heel unit comprises a second selectively positionable heel support which is supported by the first heel support when both the first and second heel supports are in deployed positions.

17. The binding kit of claim 15, wherein movement of the first heel support towards the deployed position actuates movement of the upper portion to the touring position.

18. The binding kit of claim 11, wherein the toe and heel units are not connected, except through mounting of both units on the snow travel aid.

19. The binding kit of claim 11, mounted on a ski with said toe and heel units spaced apart to receive said footwear.

20. An apparatus for selectively holding a footwear heel to a snow travel aid, the apparatus comprising:

a base mountable to the snow travel aid; and an upper portion having a connector for connecting the apparatus to the heel;

wherein the upper portion is slidably engageable with the base for controllable movement by a user of the upper portion relative to the base into:

(i) a downhill position whereby the connector would be connected to the heel, and (ii) a touring position spaced rearwardly from the downhill position whereby the connector would be disconnected from the heel;

wherein complete movement in at least one direction between said downhill and touring positions is actuated by a single motion of an actuator; wherein the upper portion is rotatable along a generally vertical axis between lateral release positions and comprises a biasing device that urges the upper portion to remain between said lateral release positions; and, wherein the connector comprises one or more projections for insertion into one or more cavities in the footwear heel, and the one or more projections are moveable between a heel holding position and a forward release position, the upper portion further comprising a biasing device for urging the one or more projections into the heel holding position.

21. The apparatus of claim 20, wherein the single motion of the actuator actuates a device that drives said complete movement.

22. The apparatus of claim 20, wherein the single motion of the actuator drives said complete movement.

23. The apparatus of claim 20, wherein the actuator is a lever and single motions of the lever in opposite directions result in complete movement in opposite directions between the downhill and touring positions.

24. The apparatus of claim 20, further comprising at least one biasing device for urging the upper portion towards at least one of the downhill and touring positions.

25. The apparatus of claim 24, further comprising a second selectively positionable heel support which is supported by the first heel support when both the first and second heel supports are in deployed positions.

26. The apparatus of claim 20, further comprising a first heel support selectively positionable between deployed and stowed positions, wherein the first heel support is pivotably coupled to opposite sides of the base and straddles the upper portion while pivoting between the deployed and stowed positions.

27. A binding kit comprising toe and heel units, each unit for selectively holding footwear to a snow travel aid, the toe unit being configured to function independently from the heel unit to retain the footwear toe on the snow travel aid while permitting forward and rearward movement of the footwear, and wherein each heel unit is an apparatus according to claim 6.

28. A binding kit comprising toe and heel units, each unit for selectively holding footwear to a snow travel aid, the toe unit being configured to function independently from the heel unit to retain the footwear toe on the snow travel aid while permitting forward and rearward movement of the footwear, and wherein the heel unit is an apparatus according to claim 20.

29. A binding kit comprising toe holding and heel holding units for holding footwear to a snow travel aid, the toe unit being configured to grip the footwear at the footwear toe and retain the footwear on the snow travel aid without holding of the footwear by the heel unit while permitting forward and rearward pivoting of the footwear on the snow travel aid and wherein the heel unit comprises:

a base mountable to the snow travel aid; and an upper portion having a connector for connecting with the footwear heel;

wherein the upper portion is slidably engageable with the base for controllable movement of the upper portion relative to the base into:

(i) a downhill position whereby the connector would be connected to the footwear heel while the footwear toe is gripped by the toe unit, and (ii) a touring position spaced rearward from the downhill position whereby the connector would be disconnected from the footwear heel while the footwear toe is gripped by the toe unit;

wherein complete movement in at least one direction between the downhill and touring positions is actuated by a single motion of an actuator.

30. The binding kit of claim 29, wherein the connector of the heel unit comprises one or more projections for insertion into one or more cavities in the footwear heel, wherein the one or more projections are moveable between a footwear heel holding position and a release position.

31. The binding kit of claim 30, wherein the release position of the one or more projections is a forward release position and wherein the upper portion is rotatable about a generally vertical axis between lateral release positions.

32. The binding kit of claim 29, wherein the single motion of the actuator actuates a device that drives said complete movement.

33. The binding kit of claim 29, wherein the single motion of the actuator drives said complete movement.

34. The binding kit of claim 29, wherein the heel unit further comprises at least one biasing device for urging the upper portion towards at least one of the downhill and touring positions.

35. The binding kit of claim 29, wherein the heel unit further comprises a first heel support selectively positionable between deployed and stowed position.

36. The binding kit of claim 35, wherein the heel unit comprises a second selectively positionable heel support which is supported by the first heel support when both the first and second heel supports are in deployed positions.

37. The binding kit of claim 29, wherein the heel unit further comprises a brake moveable between a braking position whereby the brake is positioned to contact snow and a raised position whereby the brake would be positioned above the snow and a brake holder moveable in response to movement of the upper portion between the downhill and touring positions, the brake holder for holding the brake in the raised position when the upper portion is in the touring position.

38. The binding kit of claim 29, wherein in use, the toe and heel units are separate and are connected only by the snow travel aid when both units are mounted on the snow travel aid.

39. The binding kit of claim 29, mounted on a ski with said toe and heel units spaced apart to receive said footwear, wherein the toe unit is stationary when in use.

* * * * *